US006175194B1

(12) United States Patent
Saegusa et al.

(10) Patent No.: US 6,175,194 B1
(45) Date of Patent: Jan. 16, 2001

(54) METHOD FOR DRIVING A PLASMA DISPLAY PANEL

(75) Inventors: Nobuhiko Saegusa; Tsutomu Tokunaga, both of Yamanashi (JP)

(73) Assignee: Pioneer Corporation, Tokyo (JP)

( * ) Notice: Under 35 U.S.C. 154(b), the term of this patent shall be extended for 0 days.

(21) Appl. No.: 09/453,414

(22) Filed: Dec. 3, 1999

(30) Foreign Application Priority Data

Feb. 19, 1999 (JP) ..... 11-041298

(51) Int. Cl.[7] ..... G09G 3/10

(52) U.S. Cl. ..... 315/169.4; 315/169.1; 345/67; 345/68

(58) Field of Search ..... 315/169.1, 169.4; 345/60, 76, 67, 68

(56) References Cited

U.S. PATENT DOCUMENTS 5,990,630 * 11/1999 Nakamura ..... 315/169.4

* cited by examiner

*Primary Examiner*—David Vu
(74) *Attorney, Agent, or Firm*—Sughrue, Mion, Zinn, Macpeak & Seas, PLLC

(57) ABSTRACT

A method for driving a plasma display panel in which radiation noise is reduced while preventing an erroneous discharge and a display quality can be improved. Either one of scanning pulses and sustaining pulses changes in its repetitive period between at least two sub-fields.

6 Claims, 21 Drawing Sheets

FIG.11

| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| MODE 1 | 1 | 3 | 5 | 8 | 10 | 13 | 16 | 19 | 22 | 25 | 28 | 32 | 35 | 39 |
| MODE 2 | 2 | 6 | 10 | 16 | 20 | 26 | 32 | 38 | 44 | 50 | 56 | 64 | 70 | 78 |
| MODE 3 | 3 | 9 | 15 | 24 | 30 | 39 | 48 | 57 | 66 | 75 | 84 | 96 | 105 | 117 |
| MODE 4 | 4 | 12 | 20 | 32 | 40 | 52 | 64 | 76 | 88 | 100 | 112 | 128 | 140 | 156 |

FIG.13

| LUMINANCE | DBL 0 ~ 7 | LUMINANCE | HDP 0 ~ 7 | LUMINANCE | DBL 0 ~ 7 | LUMINANCE | HDP 0 ~ 7 |
|---|---|---|---|---|---|---|---|
| 0 | 00000000 | 0 | 00000000 | 64 | 01000000 | 56 | 00111000 |
| 1 | 00000001 | 0 | 00000000 | 65 | 01000001 | 57 | 00111001 |
| 2 | 00000010 | 1 | 00000001 | 66 | 01000010 | 57 | 00111001 |
| 3 | 00000011 | 2 | 00000010 | 67 | 01000011 | 58 | 00111010 |
| 4 | 00000100 | 3 | 00000011 | 68 | 01000100 | 59 | 00111011 |
| 5 | 00000101 | 4 | 00000100 | 69 | 01000101 | 60 | 00111100 |
| 6 | 00000110 | 5 | 00000101 | 70 | 01000110 | 61 | 00111101 |
| 7 | 00000111 | 6 | 00000110 | 71 | 01000111 | 62 | 00111110 |
| 8 | 00001000 | 7 | 00000111 | 72 | 01001000 | 63 | 00111111 |
| 9 | 00001001 | 7 | 00000111 | 73 | 01001001 | 64 | 01000000 |
| 10 | 00001010 | 8 | 00001000 | 74 | 01001010 | 65 | 01000001 |
| 11 | 00001011 | 9 | 00001001 | 75 | 01001011 | 65 | 01000001 |
| 12 | 00001100 | 10 | 00001010 | 76 | 01001100 | 66 | 01000010 |
| 13 | 00001101 | 11 | 00001011 | 77 | 01001101 | 67 | 01000011 |
| 14 | 00001110 | 12 | 00001100 | 78 | 01001110 | 68 | 01000100 |
| 15 | 00001111 | 13 | 00001101 | 79 | 01001111 | 69 | 01000101 |
| 16 | 00010000 | 14 | 00001110 | 80 | 01010000 | 70 | 01000110 |
| 17 | 00010001 | 14 | 00001110 | 81 | 01010001 | 71 | 01000111 |
| 18 | 00010010 | 15 | 00001111 | 82 | 01010010 | 72 | 01001000 |
| 19 | 00010011 | 16 | 00010000 | 83 | 01010011 | 72 | 01001000 |
| 20 | 00010100 | 17 | 00010001 | 84 | 01010100 | 73 | 01001001 |
| 21 | 00010101 | 18 | 00010010 | 85 | 01010101 | 74 | 01001010 |
| 22 | 00010110 | 19 | 00010011 | 86 | 01010110 | 75 | 01001011 |
| 23 | 00010111 | 20 | 00010100 | 87 | 01010111 | 76 | 01001100 |
| 24 | 00011000 | 21 | 00010101 | 88 | 01011000 | 77 | 01001101 |
| 25 | 00011001 | 21 | 00010101 | 89 | 01011001 | 77 | 01001101 |
| 26 | 00011010 | 22 | 00010110 | 90 | 01011010 | 78 | 01001110 |
| 27 | 00011011 | 23 | 00010111 | 91 | 01011011 | 79 | 01001111 |
| 28 | 00011100 | 24 | 00011000 | 92 | 01011100 | 80 | 01010000 |
| 29 | 00011101 | 25 | 00011001 | 93 | 01011101 | 81 | 01010001 |
| 30 | 00011110 | 26 | 00011010 | 94 | 01011110 | 82 | 01010010 |
| 31 | 00011111 | 27 | 00011011 | 95 | 01011111 | 83 | 01010011 |
| 32 | 00100000 | 28 | 00011100 | 96 | 01100000 | 84 | 01010100 |
| 33 | 00100001 | 28 | 00011100 | 97 | 01100001 | 85 | 01010101 |
| 34 | 00100010 | 29 | 00011101 | 98 | 01100010 | 86 | 01010110 |
| 35 | 00100011 | 30 | 00011110 | 99 | 01100011 | 86 | 01010110 |
| 36 | 00100100 | 31 | 00011111 | 100 | 01100100 | 87 | 01010111 |
| 37 | 00100101 | 32 | 00100000 | 101 | 01100101 | 88 | 01011000 |
| 38 | 00100110 | 33 | 00100001 | 102 | 01100110 | 89 | 01011001 |
| 39 | 00100111 | 34 | 00100010 | 103 | 01100111 | 90 | 01011010 |
| 40 | 00101000 | 35 | 00100011 | 104 | 01101000 | 91 | 01011011 |
| 41 | 00101001 | 36 | 00100100 | 105 | 01101001 | 92 | 01011100 |
| 42 | 00101010 | 36 | 00100100 | 106 | 01101010 | 93 | 01011101 |
| 43 | 00101011 | 37 | 00100101 | 107 | 01101011 | 93 | 01011101 |
| 44 | 00101100 | 38 | 00100110 | 108 | 01101100 | 94 | 01011110 |
| 45 | 00101101 | 39 | 00100111 | 109 | 01101101 | 95 | 01011111 |
| 46 | 00101110 | 40 | 00101000 | 110 | 01101110 | 96 | 01100000 |
| 47 | 00101111 | 41 | 00101001 | 111 | 01101111 | 97 | 01100001 |
| 48 | 00110000 | 42 | 00101010 | 112 | 01110000 | 98 | 01100010 |
| 49 | 00110001 | 43 | 00101011 | 113 | 01110001 | 99 | 01100011 |
| 50 | 00110010 | 43 | 00101011 | 114 | 01110010 | 100 | 01100100 |
| 51 | 00110011 | 44 | 00101100 | 115 | 01110011 | 101 | 01100101 |
| 52 | 00110100 | 45 | 00101101 | 116 | 01110100 | 101 | 01100101 |
| 53 | 00110101 | 46 | 00101110 | 117 | 01110101 | 102 | 01100110 |
| 54 | 00110110 | 47 | 00101111 | 118 | 01110110 | 103 | 01100111 |
| 55 | 00110111 | 48 | 00110000 | 119 | 01110111 | 104 | 01101000 |
| 56 | 00111000 | 49 | 00110001 | 120 | 01111000 | 105 | 01101001 |
| 57 | 00111001 | 50 | 00110010 | 121 | 01111001 | 106 | 01101010 |
| 58 | 00111010 | 50 | 00110010 | 122 | 01111010 | 107 | 01101011 |
| 59 | 00111011 | 51 | 00110011 | 123 | 01111011 | 108 | 01101100 |
| 60 | 00111100 | 52 | 00110100 | 124 | 01111100 | 108 | 01101100 |
| 61 | 00111101 | 53 | 00110101 | 125 | 01111101 | 109 | 01101101 |
| 62 | 00111110 | 54 | 00110110 | 126 | 01111110 | 110 | 01101110 |
| 63 | 00111111 | 55 | 00110111 | 127 | 01111111 | 111 | 01101111 |

FIG.14

| LUMINANCE | DBL | LUMINANCE | HDP | LUMINANCE | DBL | LUMINANCE | HDP |
|---|---|---|---|---|---|---|---|
| | 0 ~ 7 | | 0 ~ 7 | | 0 ~ 7 | | 0 ~ 7 |
| 128 | 10000000 | 112 | 01110000 | 192 | 11000000 | 168 | 10101000 |
| 129 | 10000001 | 113 | 01110001 | 193 | 11000001 | 169 | 10101001 |
| 130 | 10000010 | 114 | 01110010 | 194 | 11000010 | 170 | 10101010 |
| 131 | 10000011 | 115 | 01110011 | 195 | 11000011 | 171 | 10101011 |
| 132 | 10000100 | 115 | 01110011 | 196 | 11000100 | 172 | 10101100 |
| 133 | 10000101 | 116 | 01110100 | 197 | 11000101 | 173 | 10101101 |
| 134 | 10000110 | 117 | 01110101 | 198 | 11000110 | 173 | 10101101 |
| 135 | 10000111 | 118 | 01110110 | 199 | 11000111 | 174 | 10101110 |
| 136 | 10001000 | 119 | 01110111 | 200 | 11001000 | 175 | 10101111 |
| 137 | 10001001 | 120 | 01111000 | 201 | 11001001 | 176 | 10110000 |
| 138 | 10001010 | 121 | 01111001 | 202 | 11001010 | 177 | 10110001 |
| 139 | 10001011 | 122 | 01111010 | 203 | 11001011 | 178 | 10110010 |
| 140 | 10001100 | 122 | 01111010 | 204 | 11001100 | 179 | 10110011 |
| 141 | 10001101 | 123 | 01111011 | 205 | 11001101 | 180 | 10110100 |
| 142 | 10001110 | 124 | 01111100 | 206 | 11001110 | 180 | 10110100 |
| 143 | 10001111 | 125 | 01111101 | 207 | 11001111 | 181 | 10110101 |
| 144 | 10010000 | 126 | 01111110 | 208 | 11010000 | 182 | 10110110 |
| 145 | 10010001 | 127 | 01111111 | 209 | 11010001 | 183 | 10110111 |
| 146 | 10010010 | 128 | 10000000 | 210 | 11010010 | 184 | 10111000 |
| 147 | 10010011 | 129 | 10000001 | 211 | 11010011 | 185 | 10111001 |
| 148 | 10010100 | 130 | 10000010 | 212 | 11010100 | 186 | 10111010 |
| 149 | 10010101 | 130 | 10000010 | 213 | 11010101 | 187 | 10111011 |
| 150 | 10010110 | 131 | 10000011 | 214 | 11010110 | 187 | 10111011 |
| 151 | 10010111 | 132 | 10000100 | 215 | 11010111 | 188 | 10111100 |
| 152 | 10011000 | 133 | 10000101 | 216 | 11011000 | 189 | 10111101 |
| 153 | 10011001 | 134 | 10000110 | 217 | 11011001 | 190 | 10111110 |
| 154 | 10011010 | 135 | 10000111 | 218 | 11011010 | 191 | 10111111 |
| 155 | 10011011 | 136 | 10001000 | 219 | 11011011 | 192 | 11000000 |
| 156 | 10011100 | 137 | 10001001 | 220 | 11011100 | 193 | 11000001 |
| 157 | 10011101 | 137 | 10001001 | 221 | 11011101 | 194 | 11000010 |
| 158 | 10011110 | 138 | 10001010 | 222 | 11011110 | 195 | 11000011 |
| 159 | 10011111 | 139 | 10001011 | 223 | 11011111 | 195 | 11000011 |
| 160 | 10100000 | 140 | 10001100 | 224 | 11100000 | 196 | 11000100 |
| 161 | 10100001 | 141 | 10001101 | 225 | 11100001 | 197 | 11000101 |
| 162 | 10100010 | 142 | 10001110 | 226 | 11100010 | 198 | 11000110 |
| 163 | 10100011 | 143 | 10001111 | 227 | 11100011 | 199 | 11000111 |
| 164 | 10100100 | 144 | 10010000 | 228 | 11100100 | 200 | 11001000 |
| 165 | 10100101 | 144 | 10010000 | 229 | 11100101 | 201 | 11001001 |
| 166 | 10100110 | 145 | 10010001 | 230 | 11100110 | 202 | 11001010 |
| 167 | 10100111 | 146 | 10010010 | 231 | 11100111 | 202 | 11001010 |
| 168 | 10101000 | 147 | 10010011 | 232 | 11101000 | 203 | 11001011 |
| 169 | 10101001 | 148 | 10010100 | 233 | 11101001 | 204 | 11001100 |
| 170 | 10101010 | 149 | 10010101 | 234 | 11101010 | 205 | 11001101 |
| 171 | 10101011 | 150 | 10010110 | 235 | 11101011 | 206 | 11001110 |
| 172 | 10101100 | 151 | 10010111 | 236 | 11101100 | 207 | 11001111 |
| 173 | 10101101 | 151 | 10010111 | 237 | 11101101 | 208 | 11010000 |
| 174 | 10101110 | 152 | 10011000 | 238 | 11101110 | 209 | 11010001 |
| 175 | 10101111 | 153 | 10011001 | 239 | 11101111 | 209 | 11010001 |
| 176 | 10110000 | 154 | 10011010 | 240 | 11110000 | 210 | 11010010 |
| 177 | 10110001 | 155 | 10011011 | 241 | 11110001 | 211 | 11010011 |
| 178 | 10110010 | 156 | 10011100 | 242 | 11110010 | 212 | 11010100 |
| 179 | 10110011 | 157 | 10011101 | 243 | 11110011 | 213 | 11010101 |
| 180 | 10110100 | 158 | 10011110 | 244 | 11110100 | 214 | 11010110 |
| 181 | 10110101 | 158 | 10011110 | 245 | 11110101 | 215 | 11010111 |
| 182 | 10110110 | 159 | 10011111 | 246 | 11110110 | 216 | 11011000 |
| 183 | 10110111 | 160 | 10100000 | 247 | 11110111 | 216 | 11011000 |
| 184 | 10111000 | 161 | 10100001 | 248 | 11111000 | 217 | 11011001 |
| 185 | 10111001 | 162 | 10100010 | 249 | 11111001 | 218 | 11011010 |
| 186 | 10111010 | 163 | 10100011 | 250 | 11111010 | 219 | 11011011 |
| 187 | 10111011 | 164 | 10100100 | 251 | 11111011 | 220 | 11011100 |
| 188 | 10111100 | 165 | 10100101 | 252 | 11111100 | 221 | 11011101 |
| 189 | 10111101 | 166 | 10100110 | 253 | 11111101 | 222 | 11011110 |
| 190 | 10111110 | 166 | 10100110 | 254 | 11111110 | 223 | 11011111 |
| 191 | 10111111 | 167 | 10100111 | 255 | 11111111 | 224 | 11100000 |

FIG.19

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASURE DISCHARGE
WHITE CIRCLE : LIGHT EMISSION SF

FIG. 21

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|---|
| 0000 | 1 | 1 | 0 | 0 | 0 | 0 | 0 | 0 | 0 | 0 | 0 | 0 | 0 | 0 | ● | ● | | | | | | | | | | | | | 0 |
| 0001 | 0 | 1 | 1 | 0 | 0 | 0 | 0 | 0 | 0 | 0 | 0 | 0 | 0 | 0 | ○ | ● | ● | | | | | | | | | | | | 1 |
| 0010 | 0 | 0 | 1 | 1 | 0 | 0 | 0 | 0 | 0 | 0 | 0 | 0 | 0 | 0 | ○ | ○ | ● | ● | | | | | | | | | | | 4 |
| 0011 | 0 | 0 | 0 | 1 | 1 | 0 | 0 | 0 | 0 | 0 | 0 | 0 | 0 | 0 | ○ | ○ | ○ | ● | ● | | | | | | | | | | 9 |
| 0100 | 0 | 0 | 0 | 0 | 1 | 1 | 0 | 0 | 0 | 0 | 0 | 0 | 0 | 0 | ○ | ○ | ○ | ○ | ● | ● | | | | | | | | | 17 |
| 0101 | 0 | 0 | 0 | 0 | 0 | 1 | 1 | 0 | 0 | 0 | 0 | 0 | 0 | 0 | ○ | ○ | ○ | ○ | ○ | ● | ● | | | | | | | | 27 |
| 0110 | 0 | 0 | 0 | 0 | 0 | 0 | 1 | 1 | 0 | 0 | 0 | 0 | 0 | 0 | ○ | ○ | ○ | ○ | ○ | ○ | ● | ● | | | | | | | 40 |
| 0111 | 0 | 0 | 0 | 0 | 0 | 0 | 0 | 1 | 1 | 0 | 0 | 0 | 0 | 0 | ○ | ○ | ○ | ○ | ○ | ○ | ○ | ● | ● | | | | | | 56 |
| 1000 | 0 | 0 | 0 | 0 | 0 | 0 | 0 | 0 | 1 | 1 | 0 | 0 | 0 | 0 | ○ | ○ | ○ | ○ | ○ | ○ | ○ | ○ | ● | ● | | | | | 75 |
| 1001 | 0 | 0 | 0 | 0 | 0 | 0 | 0 | 0 | 0 | 1 | 1 | 0 | 0 | 0 | ○ | ○ | ○ | ○ | ○ | ○ | ○ | ○ | ○ | ● | ● | | | | 97 |
| 1010 | 0 | 0 | 0 | 0 | 0 | 0 | 0 | 0 | 0 | 0 | 1 | 1 | 0 | 0 | ○ | ○ | ○ | ○ | ○ | ○ | ○ | ○ | ○ | ○ | ● | ● | | | 122 |
| 1011 | 0 | 0 | 0 | 0 | 0 | 0 | 0 | 0 | 0 | 0 | 0 | 1 | 1 | 0 | ○ | ○ | ○ | ○ | ○ | ○ | ○ | ○ | ○ | ○ | ○ | ● | ● | | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASURE DISCHARGE
WHITE CIRCLE : LIGHT EMISSION

FIG. 22

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|---|
| 0000 | 1 | 0 | 1 | 0 | 0 | 0 | 0 | 0 | 0 | 0 | 0 | 0 | 0 | 0 | ● | | ● | | | | | | | | | | | | 0 |
| 0001 | 0 | 1 | 0 | 1 | 0 | 0 | 0 | 0 | 0 | 0 | 0 | 0 | 0 | 0 | ○ | ● | | ● | | | | | | | | | | | 1 |
| 0010 | 0 | 0 | 1 | 0 | 1 | 0 | 0 | 0 | 0 | 0 | 0 | 0 | 0 | 0 | ○ | ○ | ● | | ● | | | | | | | | | | 4 |
| 0011 | 0 | 0 | 0 | 1 | 0 | 1 | 0 | 0 | 0 | 0 | 0 | 0 | 0 | 0 | ○ | ○ | ○ | ● | | ● | | | | | | | | | 9 |
| 0100 | 0 | 0 | 0 | 0 | 1 | 0 | 1 | 0 | 0 | 0 | 0 | 0 | 0 | 0 | ○ | ○ | ○ | ○ | ● | | ● | | | | | | | | 17 |
| 0101 | 0 | 0 | 0 | 0 | 0 | 1 | 0 | 1 | 0 | 0 | 0 | 0 | 0 | 0 | ○ | ○ | ○ | ○ | ○ | ● | | ● | | | | | | | 27 |
| 0110 | 0 | 0 | 0 | 0 | 0 | 0 | 1 | 0 | 1 | 0 | 0 | 0 | 0 | 0 | ○ | ○ | ○ | ○ | ○ | ○ | ● | | ● | | | | | | 40 |
| 0111 | 0 | 0 | 0 | 0 | 0 | 0 | 0 | 1 | 0 | 1 | 0 | 0 | 0 | 0 | ○ | ○ | ○ | ○ | ○ | ○ | ○ | ● | | ● | | | | | 56 |
| 1000 | 0 | 0 | 0 | 0 | 0 | 0 | 0 | 0 | 1 | 0 | 1 | 0 | 0 | 0 | ○ | ○ | ○ | ○ | ○ | ○ | ○ | ○ | ● | | ● | | | | 75 |
| 1001 | 0 | 0 | 0 | 0 | 0 | 0 | 0 | 0 | 0 | 1 | 0 | 1 | 0 | 0 | ○ | ○ | ○ | ○ | ○ | ○ | ○ | ○ | ○ | ● | | ● | | | 97 |
| 1010 | 0 | 0 | 0 | 0 | 0 | 0 | 0 | 0 | 0 | 0 | 1 | 0 | 1 | 0 | ○ | ○ | ○ | ○ | ○ | ○ | ○ | ○ | ○ | ○ | ● | | ● | | 122 |
| 1011 | 0 | 0 | 0 | 0 | 0 | 0 | 0 | 0 | 0 | 0 | 0 | 1 | 0 | 1 | ○ | ○ | ○ | ○ | ○ | ○ | ○ | ○ | ○ | ○ | ○ | ● | | ● | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASURE DISCHARGE
WHITE CIRCLE : LIGHT EMISSION

FIG. 23

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|---|
| 0000 | 1 | 1 | * | * | * | * | * | * | * | * | * | * | * | * | ● | ● | △ | △ | △ | △ | △ | △ | △ | △ | △ | △ | △ | △ | 0 |
| 0001 | 0 | 1 | 1 | * | * | * | * | * | * | * | * | * | * | * | ○ | ● | ● | △ | △ | △ | △ | △ | △ | △ | △ | △ | △ | △ | 1 |
| 0010 | 0 | 0 | 1 | 1 | * | * | * | * | * | * | * | * | * | * | ○ | ○ | ● | ● | △ | △ | △ | △ | △ | △ | △ | △ | △ | △ | 4 |
| 0011 | 0 | 0 | 0 | 1 | 1 | * | * | * | * | * | * | * | * | * | ○ | ○ | ○ | ● | ● | △ | △ | △ | △ | △ | △ | △ | △ | △ | 9 |
| 0100 | 0 | 0 | 0 | 0 | 1 | 1 | * | * | * | * | * | * | * | * | ○ | ○ | ○ | ○ | ● | ● | △ | △ | △ | △ | △ | △ | △ | △ | 17 |
| 0101 | 0 | 0 | 0 | 0 | 0 | 1 | 1 | * | * | * | * | * | * | * | ○ | ○ | ○ | ○ | ○ | ● | ● | △ | △ | △ | △ | △ | △ | △ | 27 |
| 0110 | 0 | 0 | 0 | 0 | 0 | 0 | 1 | 1 | * | * | * | * | * | * | ○ | ○ | ○ | ○ | ○ | ○ | ● | ● | △ | △ | △ | △ | △ | △ | 40 |
| 0111 | 0 | 0 | 0 | 0 | 0 | 0 | 0 | 1 | 1 | * | * | * | * | * | ○ | ○ | ○ | ○ | ○ | ○ | ○ | ● | ● | △ | △ | △ | △ | △ | 56 |
| 1000 | 0 | 0 | 0 | 0 | 0 | 0 | 0 | 0 | 1 | 1 | * | * | * | * | ○ | ○ | ○ | ○ | ○ | ○ | ○ | ○ | ● | ● | △ | △ | △ | △ | 75 |
| 1001 | 0 | 0 | 0 | 0 | 0 | 0 | 0 | 0 | 0 | 1 | 1 | * | * | * | ○ | ○ | ○ | ○ | ○ | ○ | ○ | ○ | ○ | ● | ● | △ | △ | △ | 97 |
| 1010 | 0 | 0 | 0 | 0 | 0 | 0 | 0 | 0 | 0 | 0 | 1 | 1 | * | * | ○ | ○ | ○ | ○ | ○ | ○ | ○ | ○ | ○ | ○ | ● | ● | △ | △ | 122 |
| 1011 | 0 | 0 | 0 | 0 | 0 | 0 | 0 | 0 | 0 | 0 | 0 | 1 | 1 | * | ○ | ○ | ○ | ○ | ○ | ○ | ○ | ○ | ○ | ○ | ○ | ● | ● | △ | 150 |
| 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

* : "1" OR "0"

BLACK CIRCLE : SELECTIVE ERASURE DISCHARGE
WHITE CIRCLE : LIGHT EMISSION

METHOD FOR DRIVING A PLASMA DISPLAY PANEL

BACKGROUND OF THE INVENTION

1. Field of the Invention

The invention relates to a method for driving a plasma display panel (hereinafter, referred to as PDP) of a matrix display system.

2. Description of the Related Art

In recent years, a thin display apparatus has been requested in association with the increase in size of a display apparatus and various thin display apparatuses have been put into practical use. Attention is paid to an AC (alternating current discharge) type PDP as one type of the thin display apparatuses.

The PDP has a plurality of column electrodes (address electrodes) and a plurality of row electrodes arranged so as to intersect the column electrodes. Each of the row electrode pairs and the column electrodes are covered by a dielectric layer against a discharge space and have a structure such that a discharge cell corresponding to one pixel is formed at an intersecting point of the row electrode pair and the column electrode. Since the PDP provides a light emission display by using a discharge phenomenon, each of the discharge cells has only two states: a state where the light emission is performed and a state where it is not performed. A sub-field method is used to provide a halftone luminance display by the PDP. In the sub-field method, a display period of one field is divided into N sub-fields, a light emitting period having a duration period corresponding to a weight of each bit digit of the pixel data (N bits) is allocated every sub-field, and the light emission driving is performed.

FIG. 1 is a diagram showing a schematic construction of a plasma display apparatus for performing the halftone luminance display by using the sub-field method.

In FIG. 1, a driving apparatus 100 converts a supplied video signal into digital pixel data corresponding to each pixel, applies pixel data pulses corresponding to the pixel data to column electrodes $D_1$ to $D_m$ of a PDP 10. The driving apparatus 100 applies various driving pulses as will be explained as follows to row electrodes $X_1$ to $X_n$ and $Y_1$ to $Y_n$, thereby performing a light emission drive control. One pair of row electrodes X and Y constitutes one row of the PDP 10 and is formed so as to intersect each of the column electrodes $D_1$ to $D_m$. The column electrodes and the row electrode pairs are formed so as to sandwich a dielectric material (not shown). One pixel cell is formed in a portion where a set of column electrode and row electrode pair cross.

FIG. 2 is a diagram showing an example of a light emission driving format in one field period by the driving apparatus 100.

As shown in FIG. 2, the display period of one field is divided into four sub-fields SF1 to SF4. In each sub-field, an all-resetting step $R_c$, a pixel data writing step $W_c$, a light emission sustaining step $I_c$, and an erasing step E are executed, respectively.

FIG. 3 is a timing diagram (in one sub-field) of various driving pulses which are applied at each step from the driving apparatus 100 to the column electrodes and row electrode pairs of the PDP 10, respectively.

First, in the all-resetting step $R_c$, the driving apparatus 100 simultaneously applies a reset pulse $RP_x$ of a negative polarity and a reset pulse $RP_y$ of a positive polarity as shown in FIG. 3 to the row electrodes $X_1$ to $X_n$ and $Y_1$ to $Y_n$, respectively. In response to the applied reset pulses $RP_X$ and $RP_Y$, all of the discharge cells in the PDP 10 are reset-discharged and a predetermined amount of wall charges are uniformly formed in each discharge cell. All of the discharge cells, thus, are once initially set to "light emitting cells".

In the next pixel data writing step $W_c$, the driving apparatus 100 sequentially applies a pixel data pulse group $DP_1$ to $DP_n$ of each row to the column electrodes $D_1$ to $D_m$ at a predetermined scanning pulse period $T_a$ as shown in FIG. 3. For example, in the pixel data writing step $W_c$ of the sub-field SF1, only the first bit is extracted from each of the input pixel data corresponding to each one of all of the discharge cells of the PDP 10 and the pixel data pulse group DP according to the logic level of the first bit is sequentially applied to the column electrodes $D_1$ to $D_m$ every row. In the sub-field SF2, only the second bit is extracted from each of the input pixel data corresponding to each of all discharge cells of the PDP 10 and the pixel data pulse group DP according to the logic level of the second bit is sequentially applied to the column electrodes $D_1$ to $D_m$ every row. Further, the driving apparatus 100 sequentially applies scanning pulses SP of a negative polarity as shown in FIG. 3 to the row electrodes $Y_1$ to $Y_n$ at the scanning pulse period at the same timing as each applying timing of the pixel data pulse group DP. A discharge (selective erasure discharge) occurs in only the discharge cell in the intersecting portion of the "row" to which the scanning pulse SP was applied and the "column" to which the pixel data pulse of a high voltage was applied. The wall charges remaining in the discharge cell are selectively erased. By the selective erasure discharge, the discharge cell which was initialized to the state of the "light emitting cell" in the all-resetting step $R_c$ is shifted to the "non-light emitting cell". The selective erasure discharge is not caused in the discharge cell to which the pixel data pulse of a low voltage was applied simultaneously with the scanning pulse SP and the state where it is initialized in the all-resetting step, namely, the state of the "light emitting cell" is maintained. The driving apparatus 100 applies a priming pulse PP of a positive polarity as shown in FIG. 3 to the row electrodes $Y_1$ to $Y_n$ just before each scanning pulse SP is applied to each row electrode Y. A priming discharge occurs every row in response to the priming pulse PP applied. By the priming discharge, the charged particles which were reduced with the elapse of time although they had been obtained by the all-resetting operation are again formed in the discharge space of the PDP 10. Since the scanning pulse SP is applied just after the charged particles were again formed, therefore, the selective erasure discharge is certainly caused and the erroneous writing of the pixel data is prevented.

In the light emission sustaining step $I_c$, subsequently, the driving apparatus 100 repetitively applies a sustaining pulse $IP_X$ of a positive polarity as shown in FIG. 3 to the row electrodes $X_1$ to $X_n$ at a predetermined sustaining pulse period $T_s$. Further, the driving apparatus 100 repetitively applies a sustaining pulse $IP_Y$ of a positive polarity as shown in FIG. 3 to the row electrodes $Y_1$ to $Y_n$ at the predetermined sustaining pulse period $T_s$ for a period of time during which the sustaining pulse $IP_X$ is not applied to the row electrodes $X_1$ to $X_n$. The number of times (period) of applying the sustaining pulses $IP_X$ and $IP_Y$ in each sub-field is set in correspondence to the weight of each sub-field.

For example, as shown in FIG. 2, the sustaining pulses $IP_X$ and $IP_Y$ are applied by only the number shown by the following ratios of the number of times (period) in each of the sub-fields SF1 to SF4.

SF1:1

SF2:2

SF3:4

SF4:8

After completion of the pixel data writing step $W_c$, the discharge cells in which the wall charges remain, namely, only the "light emitting cells" discharge-emit the light each time the sustaining pulses $IP_X$ and $IP_Y$ are alternately applied. That is, in the pixel data writing step $W_c$, only the discharge cells set to the "light emitting cells" repeat the flickering operation for only the number of times (period) as mentioned above and maintain the light emitting state.

In the erasing step E, subsequently, the driving apparatus 100 applies the erasing pulse EP as shown in FIG. 3 to the row electrodes $X_1$ to $X_n$ , thereby allowing all of the discharge cells to be erasure-discharged at the same time and erasing the wall charges remaining in each discharge cell.

By executing the driving as shown in FIG. 3 mentioned above for each of the sub-fields SF1 to SF4 in FIG. 2, a halftone luminance display of 15 stages can be performed.

The driving method, however, has a problem in that a spectrum of radiation noise which is generated by the pulse train of the sustaining pulses $IP_X$ and $IP_Y$ is concentrated to a specific frequency, so that the radiation noise increase.

There is also a problem such that if the scanning pulse period $T_a$ and sustaining pulse period $T_s$ as shown in FIG. 3 are shortened to cope with various refreshing rates of the video signal, an erroneous discharge may occur.

OBJECTS AND SUMMARY OF THE INVENTION

The invention is made to solve the above problems and it is an object of the invention to provide a method for driving a plasma display panel which can improve a display quality by reducing radiation noise while preventing an erroneous discharge.

According to the invention, there is provided a method for driving a plasma display panel having discharge cells each corresponding to one pixel formed at each of the intersecting points between a plurality of row electrodes arranged at the respective scanning lines and a plurality of column electrodes intersecting said row electrodes, in response to a video signal, at each of successively appearing sub-fields forming each of the fields of said video signal, which comprises: in each of said sub-fields, executing a pixel data writing step of sequentially applying a scanning pulse to cause a selective discharge to set said discharge cell to either a light emitting cell or a non-light emitting cell in accordance with pixel data to each of said row electrodes; and a light emission sustaining step of applying a sustaining pulse to cause a sustaining discharge in only the light emitting cell to each of said row electrodes by only the number of times corresponding to a weight of said sub-field, in which either one of said scanning pulses and said sustaining pulses changes in its repetitive period between at least two of said sub-fields.

BRIEF DESCRIPTION OF THE DRAWINGS

FIG. 11 is a diagram showing a correspondence relation between a luminance mode and a ratio of the number of times of light emission which is executed in a light emission sustaining step of each sub-field;

FIG. 13 is a diagram showing an example of a conversion table in the first data converting circuit 32;

FIG. 14 is a diagram showing an example of a conversion table in the first data converting circuit 32;

FIG. 19 is a diagram showing an example of all patterns of the light emission driving which is executed on the basis of the light emission driving format shown in FIG. 6 and a conversion table which is used in a second data converting circuit 34 when the light emission driving is executed;

FIG. 21 is a diagram showing another example of all patterns of the light emission driving which is executed on the basis of the light emission driving format shown in FIG. 6 and a conversion table which is used in the second data converting circuit 34 when the light emission driving is executed;

FIG. 22 is a diagram showing still another example of all patterns of the light emission driving which is executed on the basis of the light emission driving format shown in FIG. 6 and a conversion table which is used in the second data converting circuit 34 when the light emission driving is executed; and FIG. 23 is a diagram showing further another example of all patterns of the light emission driving which is executed on the basis of the light emission driving format shown in FIG. 6 and a conversion table which is used in the second data converting circuit 34 when the light emission driving is executed.

DETAILED DESCRIPTION OF THE PREFERRED EMBODIMENTS

An embodiment of the invention will now be described as follows with reference to the drawings.

Figure 4:
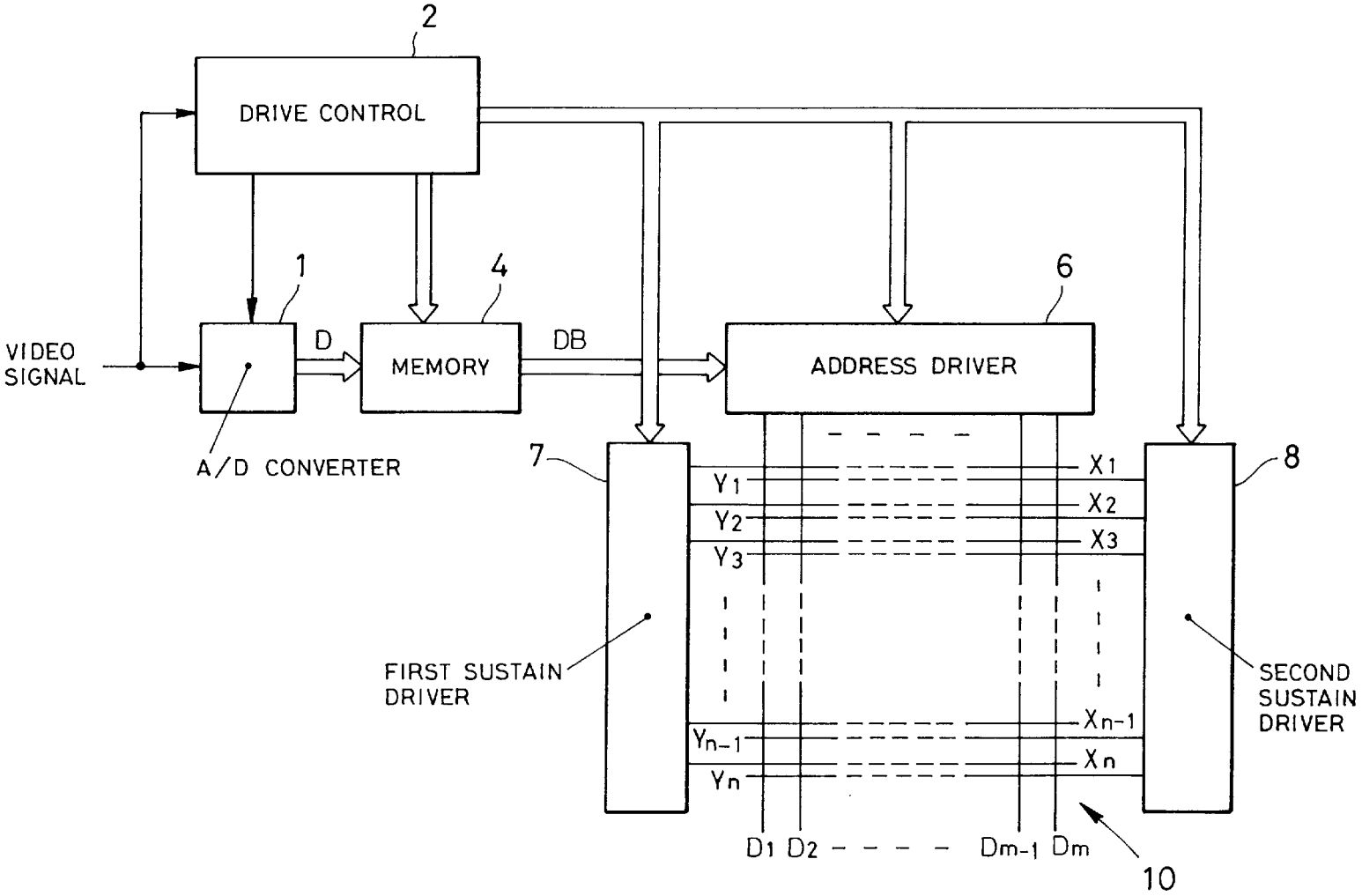
FIG. 4 is a diagram showing a schematic construction of a plasma display apparatus for light emission driving the PDP 10 on the basis of a driving method according to the invention.

FIG. 4 is a diagram showing a schematic construction of a plasma display apparatus for light emission driving a plasma display panel on the basis of a driving method according to the invention.

As shown in FIG. 4, the plasma display apparatus is constructed by: a PDP 10 as a plasma display panel; and a driving unit comprising an A/D converter 1, a drive control circuit 2, a memory 4, an address driver 6, first sustain driver 7, and second sustain driver 8.

The PDP 10 has: m column electrodes $D_1$ to $D_m$ as address electrodes; and n row electrodes $X_1$ to $X_n$ and row electrodes $Y_1$ to $Y_n$ arranged so as to intersect the column electrodes. In this instance, a pair of row electrodes X and Y constructs a row electrode corresponding to one row in the PDP 10. The column electrodes D and row electrodes X and Y are covered by a dielectric layer against a discharge space and have a structure such that a discharge cell corresponding to one pixel is formed at an intersecting point between each row electrode pair and the column electrode.

The A/D converter 1 samples a supplied analog input video signal in response to a clock signal which is supplied from the drive control circuit 2, converts the video signal into, for example, 4 bits of pixel data D for each pixel and sends it to the memory 4.

The drive control circuit 2 generates a clock signal for the A/D converter 1 and a write signal and a read signal for the memory 4 synchronously with horizontal and vertical sync signals in the input video signal. The drive control circuit 2 further generates various timing signals to drive and control the address driver 6, first sustain driver 7, and second sustain driver 8 synchronously with the horizontal and vertical sync signals.

The pixel data D is sequentially written into the memory 4 in response to the write signal supplied from the drive control circuit 2. When the writing of, for example, pixel data $D_{11-nm}$ corresponding to one picture plane (n rows, m columns) in the PDP 10 is finished by the writing operation, the pixel data $D_{11-nm}$ of one picture plane is read out from the memory 4 every bit digit in response to the read signal supplied from the drive control circuit 2.

That is, $DB1_{11-nm}$: the first bit of the pixel data $D_{11-nm}$ $DB2_{11-nm}$: the second bit of the pixel data $D_{11-nm}$ $DB3_{11-nm}$: the third bit of the pixel data $D_{11-nm}$ $DB4_{11-nm}$: the fourth bit of the pixel data $D_{11-nm}$ obtained by dividing the pixel data $D_{11-nm}$ every bit digit are sequentially read out every row and supplied to the address driver 6.

Figure 1:
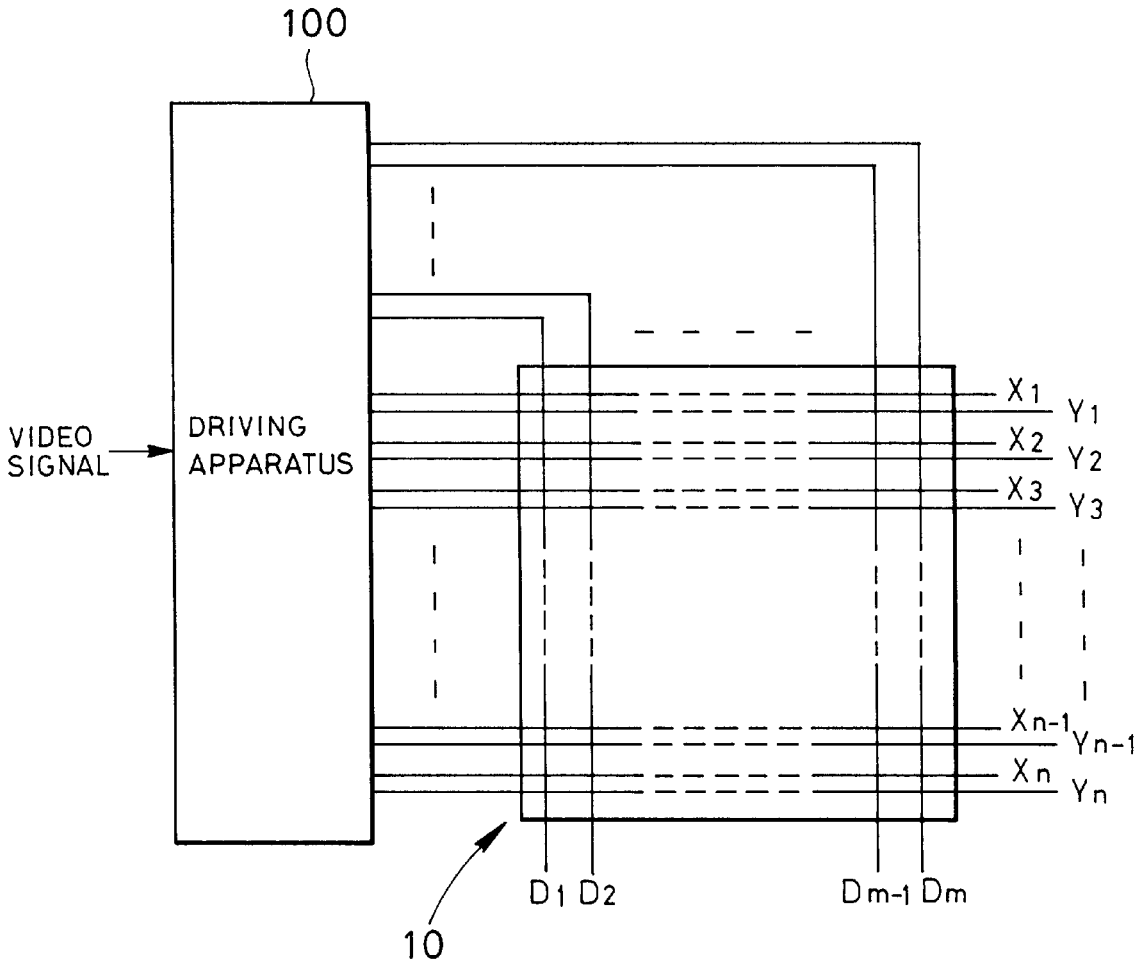
FIG. 1 is a diagram showing a schematic construction of a plasma display apparatus.
Figure 2:
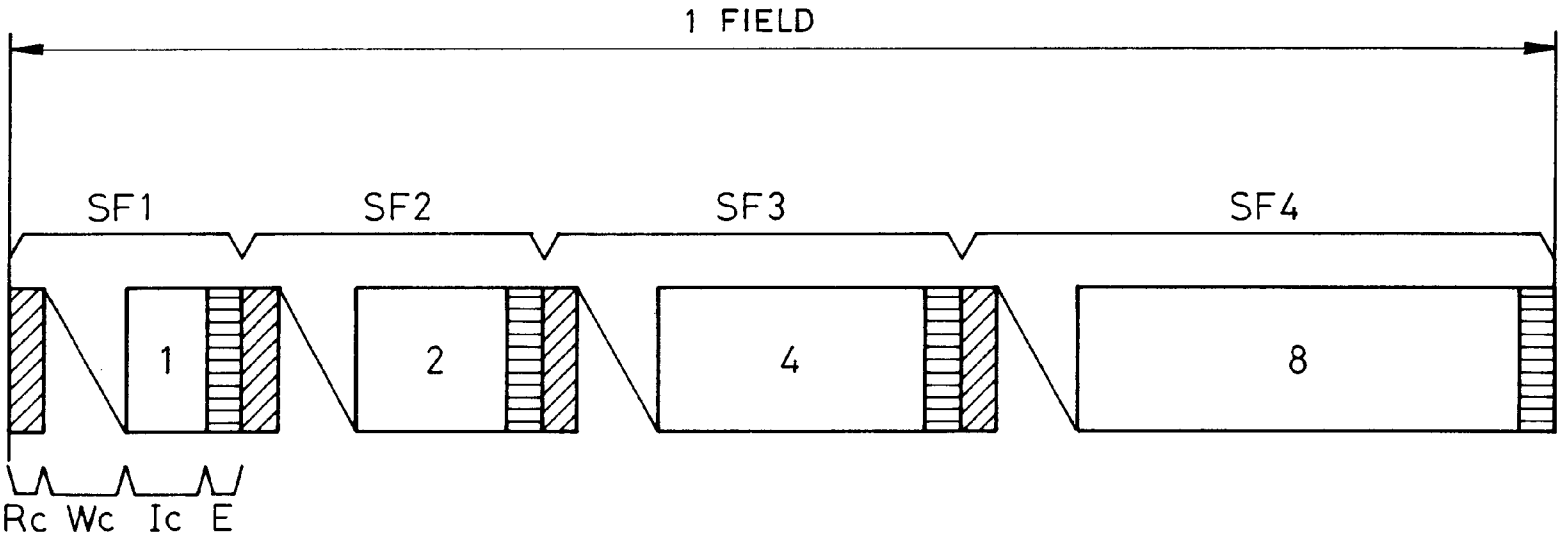
FIG. 2 is a diagram showing an example of a light emission driving format according to a sub-field method.
Figure 3:
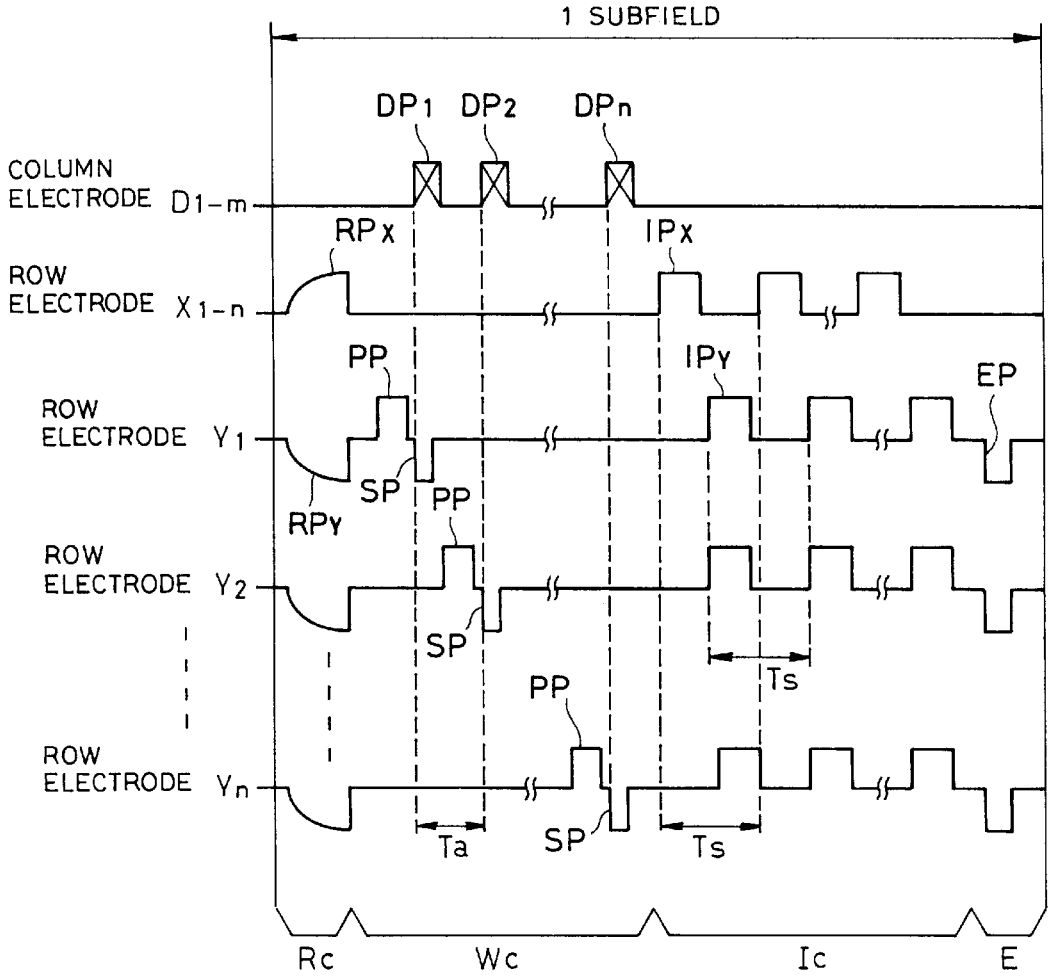
FIG. 3 is a diagram showing applying timings of various driving pulses which are applied to a PDP 10 in one sub-field.

The drive control circuit 2 supplies the various timing signals to the address driver 6, first sustain driver 7, and second sustain driver 8 in order to drive the PDP 10 for light emission in accordance with the light emission driving format as shown in FIG. 2, respectively.

Figure 5:
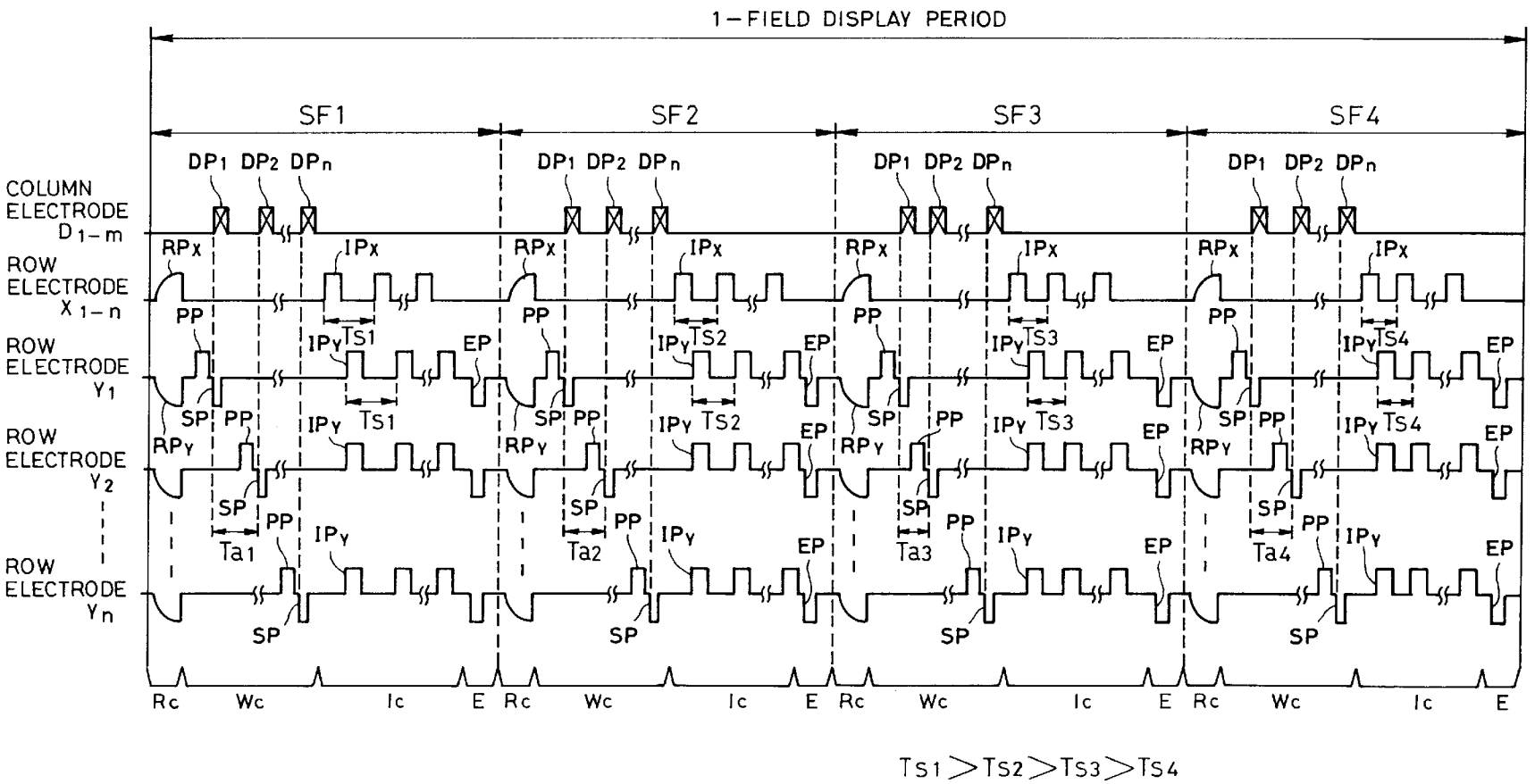
FIG. 5 is a diagram showing applying timings of various driving pulses which are applied to the PDP 10 on the basis of the driving method according to the invention.

FIG. 5 is a timing diagram showing application of various driving pulses which are applied to the column electrodes $D_1$ to $D_m$ and row electrodes $X_1$ to $X_n$ and $Y_1$ to $Y_n$ of the PDP 10 by each of the address driver 6, first sustain driver 7, and second sustain driver 8 in response to the various timing signals supplied from the drive control circuit 2, respectively.

As shown in FIG. 5, in the all-resetting step $R_c$ in each of the sub-fields SF1 to SF4, the first sustain driver 7 applies the reset pulse $RP_x$ of a positive polarity to the row electrodes $X_1$ to $X_n$. At the same time, the second sustain driver 8 applies the reset pulse $RP_Y$ of a negative polarity to the row electrodes $Y_1$ to $Y_n$. By simultaneously applying the reset pulses $RP_X$ and $RP_Y$, all discharge cells in the PDP 10 are reset-discharged and predetermined wall charges are uniformly formed in each discharge cell. All discharge cells in the PDP 10, consequently, are once initially set to the "light emitting cells".

In the pixel data writing step $W_c$ in each of the sub-fields SF1 to SF4, the address driver 6 allocates each of $DB1_{11-nm}$, $DB2_{11-nm}$, $DB3_{11-nm}$, and $DB4_{11-nm}$ supplied from the memory 4 as mentioned above to each sub-field, generates the pixel data pulse groups $DP_1$ to $DP_n$ having the voltage corresponding to the logic level of each bit every row, and sequentially applies them to the column electrodes $D_{1-m}$. For example, in the pixel data writing step $W_c$ of the sub-field SF1, first, the address driver 6 generates the pixel data pulse group $DP_1$ comprising the pixel data pulses of the number corresponding to the first row of $DB1_{11-nm}$, namely, m pixel data pulses corresponding to the logic level of each $DB1_{11-lm}$ and applies them to the column electrodes $D_{1-m}$. Subsequently, the pixel data pulse group $DP_2$ comprising m pixel data pulses corresponding to the logic level of each $DB1_{21-2m}$ corresponding to the second row of $DB1_{11-nm}$ is generated and simultaneously applied to the column electrodes $D_{1-m}$. In a manner similar to the above, the pixel data pulse groups $DP_3$ to $DP_n$ of every row are sequentially applied to the column electrodes $D_{1-m}$. In the pixel data writing step $W_c$ of the sub-field SF2, the address driver 6 first generates the pixel data pulse group $DP_1$ comprising the pixel data pulses of the number corresponding to the first row of $DB2_{11-nm}$, namely, m pixel data pulses corresponding to the logic level of each $DB2_{11-1m}$ and applies them to the column electrodes $D_{1-m}$. Subsequently, the pixel data pulse group $DP_2$ comprising m pixel data pulses corresponding to the logic level of each $DB2_{21-2m}$ corresponding to the second row of $DB2_{11-nm}$ is generated and simultaneously applied to the column electrodes $D_{1-m}$. In a manner similar to the above, the pixel data pulse groups $DP_3$ to $DP_n$ of every row are sequentially applied to the column electrodes $D_{1-m}$. It is assumed that when the logic level of DB is equal to "1", the address driver 6 generates pixel data pulses of a high voltage, and when it is equal to "0", the address driver 6 generates pixel data pulses of a low voltage (0 volt).

The second sustain driver 8 generates the scanning pulses SP of a negative polarity as shown in FIG. 5 at the same timing as each apply timing of the pixel data pulse group DP as mentioned above and sequentially applies them to the row electrodes $Y_1$ to $Y_n$. In this instance, a discharge (selective erasure discharge) occurs in only the discharge cell in the intersecting portion of the "row" to which the scanning pulse SP was applied and the "column" to which the pixel data pulse of a high voltage was applied, and the wall charges remaining in the discharge cell are selectively erased. By the selective erasure discharge, the discharge cells initialized to the state of "light emitting cells" by the all-resetting step $R_c$ are shifted to the "non-light emitting cells". No discharge occurs in the discharge cells formed on the "column" to which the pixel data pulse of a low voltage was applied, and the state initialized by the all-resetting step $R_c$, namely, the state of "light emitting cell" is maintained. Further, the second sustain driver 8 applies the priming pulses PP of a positive polarity as shown in FIG. 5 to the row electrodes $Y_1$ to $Y_n$ just before the scanning pulse SP is applied to each row electrode Y. A priming discharge occurs every row in response to the priming pulse PP applied. By the priming discharge, the charged particles which were reduced with the elapse of time although they had been obtained by the all-resetting operation are again formed in the discharge space of the PDP 10. Since the scanning pulse SP is applied just after the charged particles were again formed, therefore, the selective erasure discharge is certainly caused and the erroneous writing of the pixel data is prevented.

In this instance, the apply period of the scanning pulse SP in each sub-field, namely, the scanning pulse period $T_a$ differs for each sub-field.

That is, a scanning pulse period $T_{a1}$ in the sub-field SF1 as shown in FIG. 5 and a scanning pulse period $T_{a2}$ in the sub-field SF2 have different period duration. The scanning pulse period $T_{a2}$ and a scanning pulse period $T_{a3}$ in the sub-field SF3 have a different period duration.

In the light emission sustaining step $I_c$ in each of the sub-fields SF1 to SF4, the first sustain driver 7 and second sustain driver 8 alternately apply the sustaining pulses $IP_X$ and $IP_Y$ of a positive polarity to the row electrodes $X_1$ to $X_n$ and $Y_1$ to $Y_n$. In the light emission sustaining step $I_c$ in each sub-field, the number of times (period) of applying the sustaining pulses $IP_X$ and $IP_Y$ is set every sub-field SF. For example, as shown in FIG. 2, assuming that the number of light emitting times in the sub-field SF1 is set to "1", in the light emission sustaining step $I_c$ in each sub-field, the sustaining pulses $IP_X$ and $IP_Y$ are applied by only the numbers shown by the following ratios of the number of times (period).

SF1:1
SF2:2
SF3:4
SF4:8

By applying the sustaining pulses IP, the discharge cells in which the wall charges remain in the pixel data writing step $W_c$, namely, the "light emitting cells" are sustain-discharged each time the sustaining pulses $IP_X$ and $IP_Y$ are applied and maintain the discharge light emitting state for a time as long as only the number of times (period) allocated to each sub-field. According to the light emission sustaining step $I_c$ in the sub-field SF1, therefore, a display for a low luminance component in the input video signal is performed and, according to the light emission sustaining step $I_c$ in the sub-field SF4, a display for a high luminance component in the input video signal is performed.

In this instance, the applying periods of the sustaining pulses IP in the respective sub-fields, namely, sustaining pulse periods $T_{s1}$ to $T_{s4}$ are different and have the following duration relation.

$$T_{s1}>T_{s2}>T_{s3}>T_{s4}$$

That is, as for the sub-field in which the number of light emitting times is smaller, the sustaining pulse period $T_s$ as an applying period of the sustaining pulses IP is set to be longer.

In the driving timing diagram shown in FIG. 5, the apply periods of the scanning pulses SP and the sustaining pulses IP are made different every sub-field as mentioned above.

Therefore, the spectrum of radiation noise which generated by the pulse train of the various driving pulses is prevented from being concentrated to a predetermined frequency, thereby reducing the radiation noise.

Although the operation in the embodiment has been described with respect to the case, as an example, where one field is divided into four sub-fields and the halftone luminance display is performed, the number of sub-fields to be divided is not limited to 4.

In FIG. 5, although the apply periods of both the scanning pulses SP and sustaining pulses IP are made different every sub-field, the effects as mentioned above can be obtained even if the apply periods of either ones of the scanning pulses and the sustaining pulses are made different.

The pulse widths of the scanning pulses SP and sustaining pulses IP can be also changed in accordance with the respective apply periods. That is, when the apply period is increased, the pulse widths of the scanning pulses SP and sustaining pulses IP are also increased. When the apply period is short, the pulse widths of the scanning pulses SP and sustaining pulses IP are also set to short.

It is also possible to divide one field display period into at least two sub-field groups each comprising a plurality of continuous sub-fields and make the applying periods of the scanning pulses SP and sustaining pulses IP different between the sub-field groups.

Further, the applying periods of the scanning pulses SP and sustaining pulses IP can be made different for every field or field group comprising a plurality of fields.

Although the embodiment has been described with respect to the case where the invention is applied to the light emission driving format in which the all-resetting step $R_c$ is executed in the head portions of all sub-fields as shown in FIGS. 2 and 5, the invention is not so limited.

Figure 6:
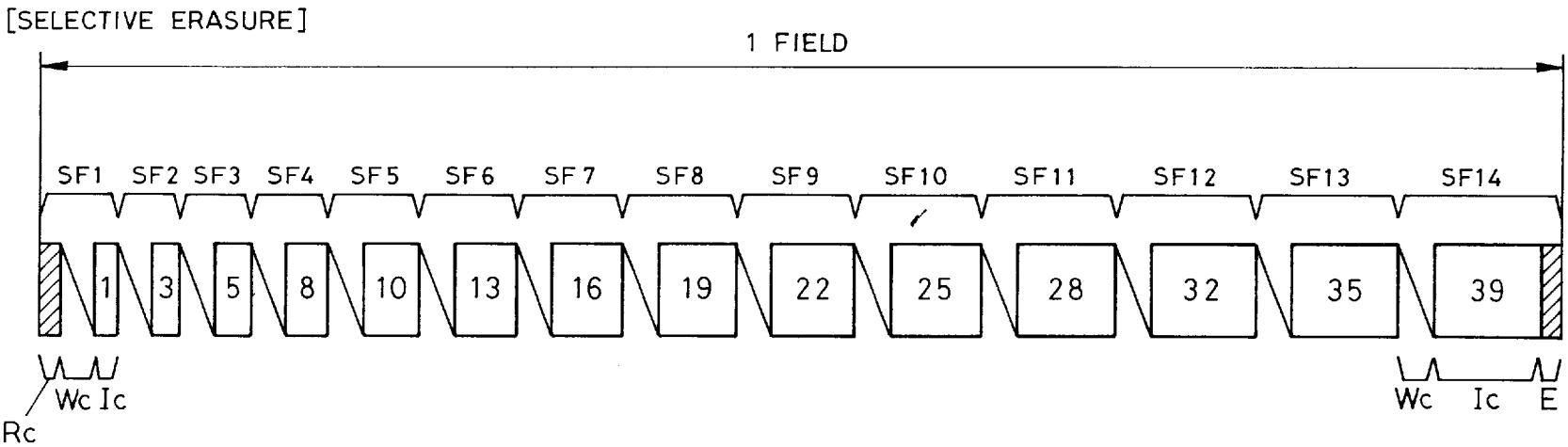
FIG. 6 is a diagram showing another example of a light emission driving format.

For example, the invention can be applied to the light emission driving format in which the all-resetting step $R_c$ is executed in only the head sub-field SF1 of one field as shown in FIG. 6.

In the light emission driving format shown in FIG. 6, the display period of one field is divided into 14 sub-fields SF1 to SF14 and the PDP is driven. In each sub-field, there are executed the pixel data writing step $W_c$ of writing the pixel data to each discharge cell of the PDP and setting the "light emitting cells" and the "non-light emitting cells" and the light emission sustaining step $I_c$ of maintaining the light emitting state by allowing only the "light emitting cells" to perform the light emission for only the number of times (period) shown in FIG. 6. In this instance, now assuming that the number of times of light emission which is executed in the light emission sustaining step $I_c$ of the sub-field SF1 is set to "1", the rate of the number of times of light emission which is executed in the light emission sustaining step $I_c$ of each sub-field is set as follows.

SF1:1
SF2:3
SF3:5
SF4:8
SF5:10
SF6:13
SF7:16
SF8:19
SF9:22
SF10:25
SF11:28
SF12:32
SF13:35
SF14:39

In this instance, the rate of the number of times of the light emission to be executed in the sub-fields SF1 to SF14 is set to be non-linear (namely, an inverse gamma ratio: $Y=X^{2.2}$) as mentioned above, thereby correcting non-linear characteristics (gamma characteristics) of the input pixel data D.

The all-resetting step $R_c$ of initializing an amount of wall charges in all discharge cells of the PDP is executed in only the head sub-field SF1 and the erasing step E of erasing the wall charges in all discharge cells in a lump is executed in only the last sub-field SF14.

Figure 7:
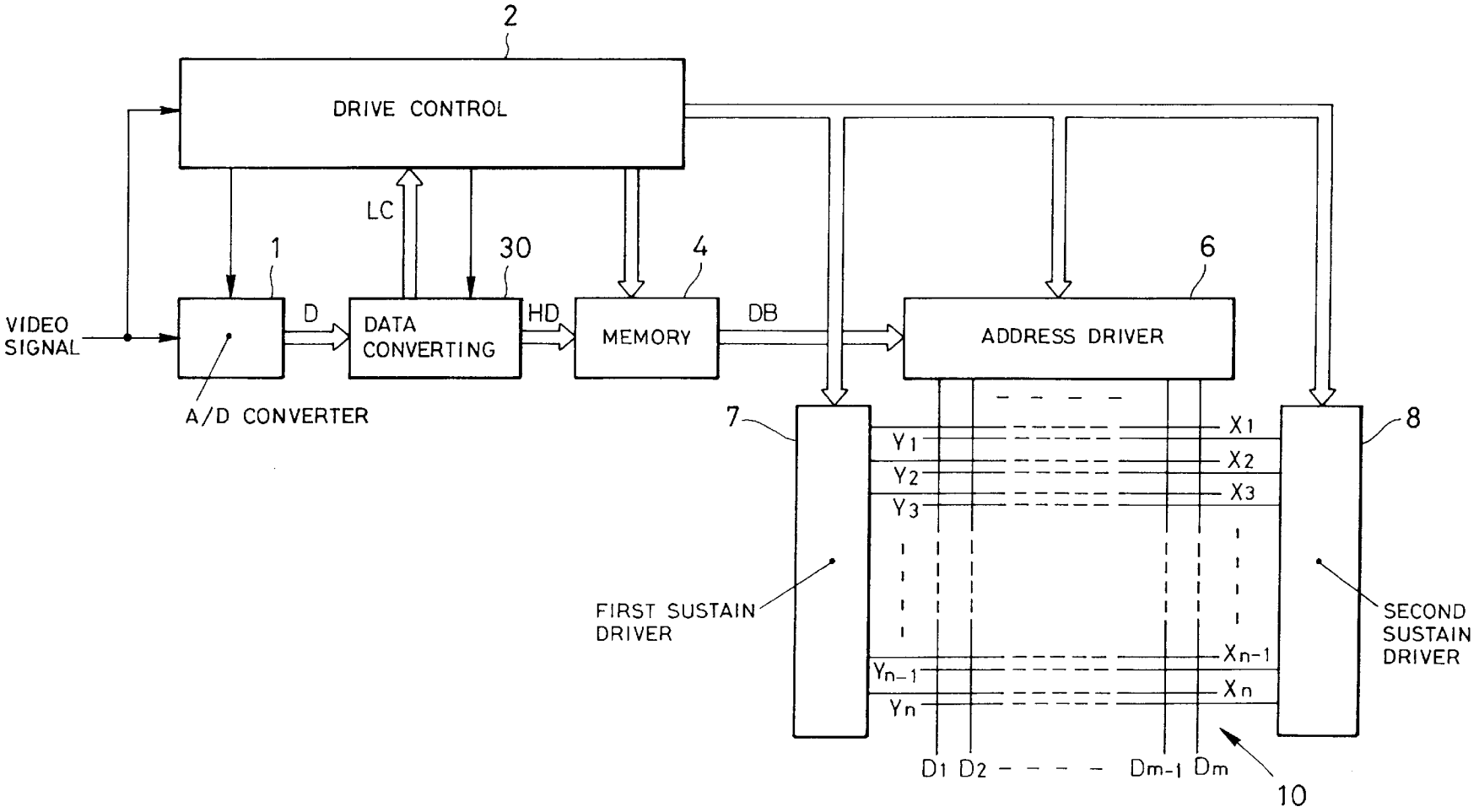
FIG. 7 is a diagram showing a schematic construction of the plasma display apparatus for light emission driving the PDP 10 in accordance with the light emission driving format shown in FIG. 6.

FIG. 7 is a diagram showing a construction of a plasma display apparatus for gradation-driving the plasma display panel on the basis of the light emission driving format shown in FIG. 6.

As shown in FIG. 7, the plasma display apparatus is constituted by: the PDP 10 as a plasma display panel; the A/D converter 1; the drive control circuit 2; a data converting circuit 30, the memory 4; the address driver 6; and a driving unit comprising the first sustain driver 7 and second sustain driver 8.

The PDP 10 has: the m column electrodes $D_1$ to $D_m$ as address electrodes; and n row electrodes $X_1$ to $X_n$ and n row electrodes $Y_1$ and $Y_n$ which are arranged so as to intersect the column electrodes, respectively. The row electrodes corresponding to one row in the PDP 10 are formed by the pairs of those row electrodes X and Y. The column electrodes D and row electrodes X and Y are covered by the dielectric layer against the discharge space and have a structure such that a discharge cell corresponding to one pixel is formed at an intersecting point of each row electrode pair and the column electrode.

The A/D converter 1 samples the analog input video signal in response to the clock signal which is supplied from the drive control circuit 2, converts it into the corresponding 8-bit pixel data D every pixel, and supplies it to the data converting circuit 30.

Figure 8:
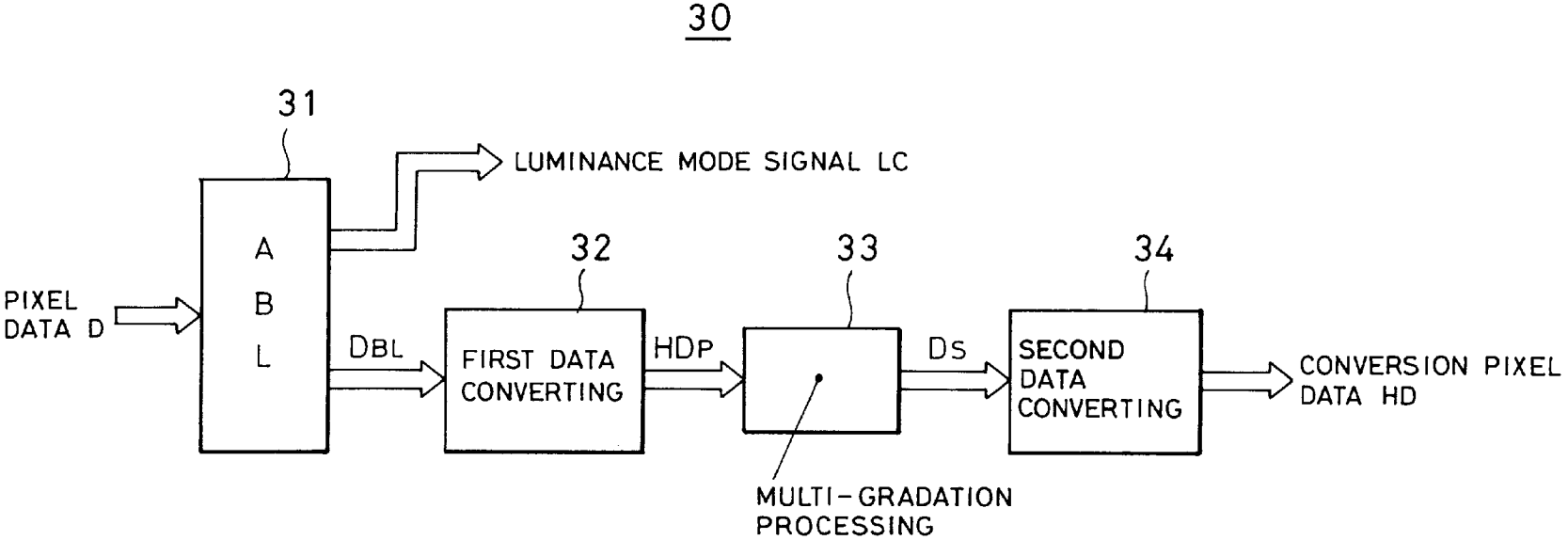
FIG. 8 is a diagram showing an internal construction of a data converting circuit 30.

FIG. 8 is a diagram showing an internal construction of the data converting circuit 30.

In FIG. 8, an ABL (automatic luminance control) circuit 31 adjusts a luminance level to the pixel data D of each pixel which is sequentially supplied from the A/D converter 1 so that the average luminance of the image which is displayed on the screen of the PDP 10 lies within a predetermined luminance range. The ABL circuit 31 supplies luminance adjustment pixel data DBL obtained in this instance to a first data converting circuit 32.

The adjustment of the luminance level is performed before the rate of the number of times of the light emission which is executed in the light emission sustaining step $I_c$ of each sub-field is set to be non-linear and the inverse gamma correction is performed as mentioned above. That is, the ABL circuit 31 automatically adjusts the luminance level of the pixel data D in accordance with the average luminance of the inverse gamma conversion pixel data obtained by performing the inverse gamma correction to the pixel data D (input pixel data), thereby preventing the deterioration of the display quality due to the luminance adjustment.

Figure 9:
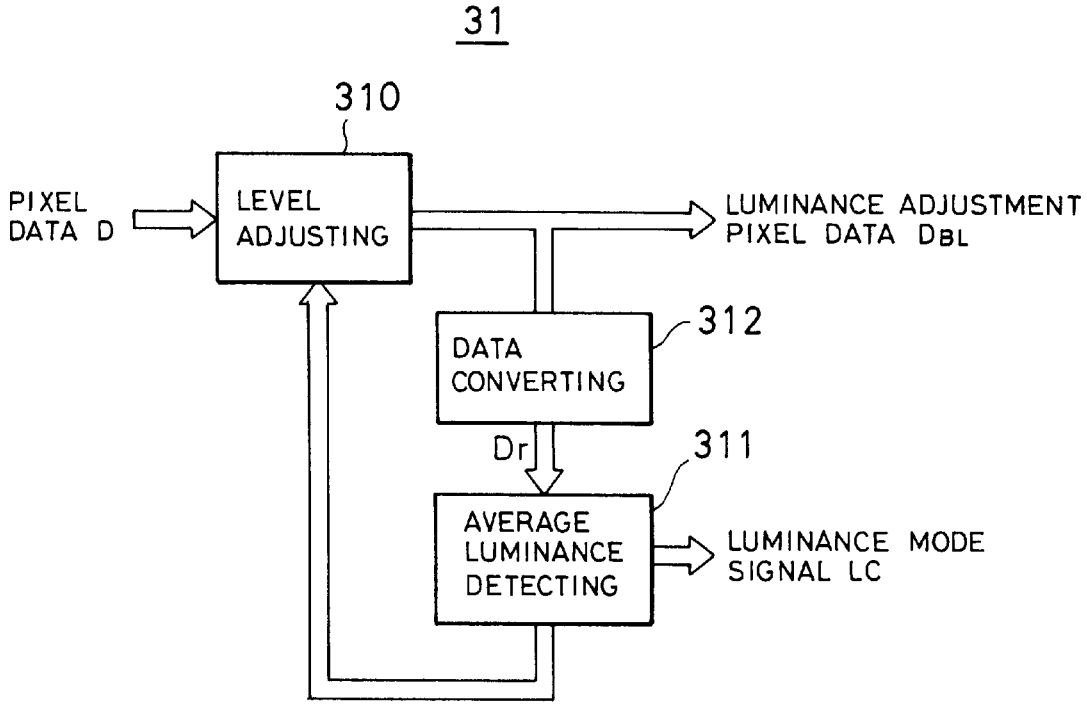
FIG. 9 is a diagram showing an internal construction of an ABL circuit 31.

FIG. 9 is a diagram showing an internal construction of the ABL circuit 31.

Figure 10:
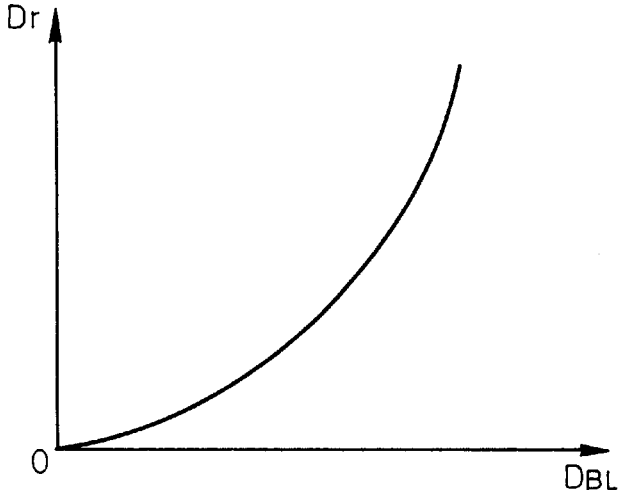
FIG. 10 is a graph showing converting characteristics in a data converting circuit 312.

In FIG. 9, a level adjusting circuit 310 generates the luminance adjustment pixel data $D_{BL}$ obtained by adjusting the level of the pixel data D in accordance with an average luminance obtained by an average luminance detecting circuit 311, which will be explained as follows. A data converting circuit 312 converts the luminance adjustment pixel data $D_{BL}$ into inverse gamma conversion pixel data Dr in accordance with inverse gamma characteristics ($Y=X^{2.2}$) as non-linear characteristics as shown in FIG. 10. A data converting circuit 312 then supplies the inverse gamma conversion pixel data Dr to the average luminance detecting circuit 311. That is, by performing the inverse gamma correcting process to the luminance adjustment pixel data $D_{BL}$, the pixel data (inverse gamma conversion pixel data Dr) corresponding to the original video signal in which the gamma correction was cancelled is reconstructed. The average luminance detecting circuit 311 obtains the average luminance of the inverse gamma conversion pixel data Dr and supplies it to the level adjusting circuit 310.

Further, the average luminance detecting circuit 311 selects a luminance mode in which the PDP 10 can be light-emission driven by the average luminance according to the average luminance from luminance modes 1 to 4 as shown in, for example, FIG. 11. A luminance mode signal LC indicative of the selected luminance mode is supplied to the drive control circuit 2. In response to the luminance mode signal LC as shown in FIG. 11, the drive control circuit 2 sets the number of times of the sustaining discharge to be performed in the light emission sustaining step $I_c$ in each of the sub-fields SF1 to SF14 shown in FIG. 6.

Figure 12:
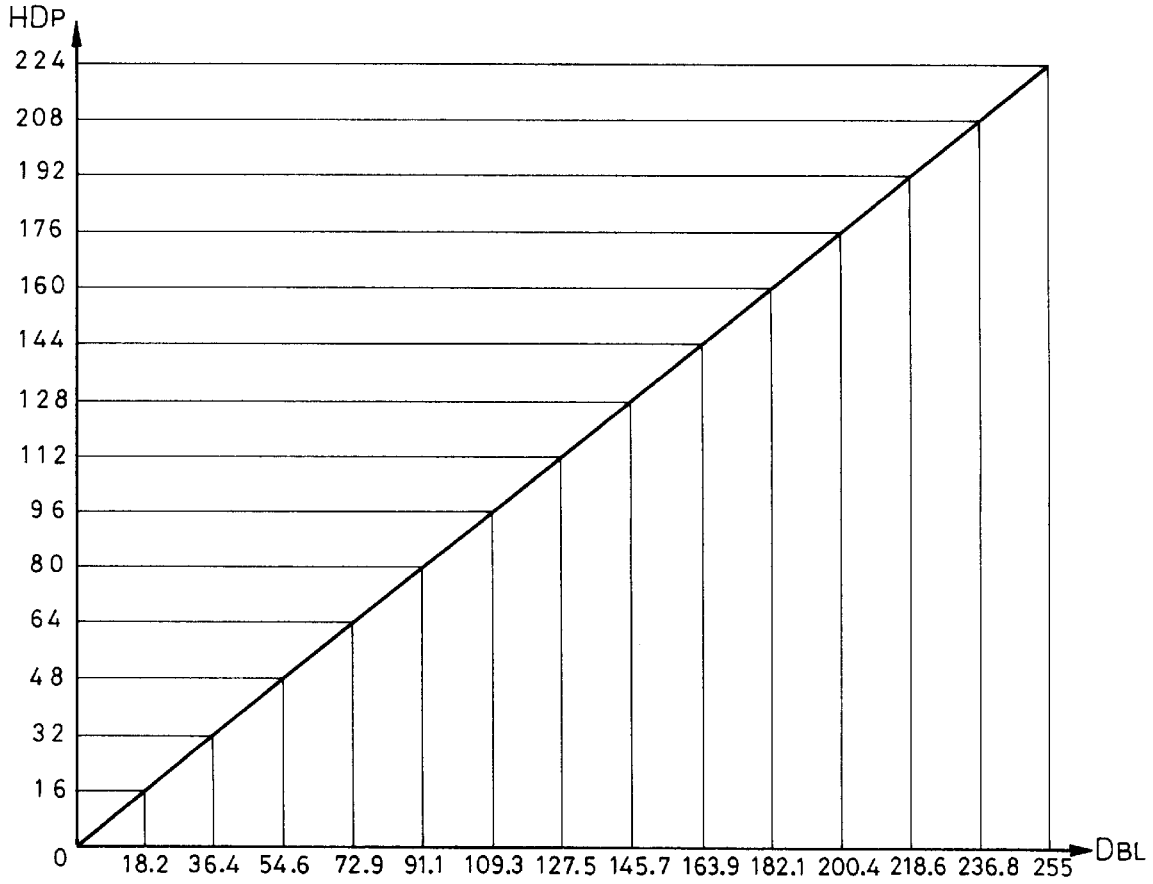
FIG. 12 is a graph showing converting characteristics in a first data converting circuit 32.

The first data converting circuit 32 shown in FIG. 8 converts the luminance adjustment pixel data $D_{BL}$ of 8 bits supplied from the ABL circuit 31 into conversion pixel data $HD_P$ of 8 bits (0~224) converted into 14×16/255 (224/255) on the basis of converting characteristics as shown in FIG. 12 and supplies it to a multi-gradation processing circuit 33. Specifically speaking, the luminance adjustment pixel data $D_{BL}$ of 8 bits (0~255) is converted in accordance with conversion tables shown in FIGS. 13 and 14 based on the converting characteristics. That is, the converting characteristics are set in accordance with the number of bits of the luminance adjustment pixel data $D_{BL}$, the number of compression bits by a multi-gradation process, which will be explained as follows, and the number of display gradations. By providing the first data converting circuit 32 at the front stage of the multi-gradation process and performing the conversion according to the number of display gradations and the number of compression bits due to the multi-gradation process, the luminance adjustment pixel data $D_{BL}$ is divided into an upper bit group (corresponding to the multi-gradation pixel data) and a lower bit group (data to be omitted: error data) at a bit boundary and the multi-gradation process is performed on the basis of this signal. By the data conversion by the first data converting circuit 32 as mentioned above, the occurrence of luminance saturation due to the multi-gradation process at the post stage and the occurrence of a flat portion of the display characteristics (namely, occurrence of a gradation distortion) occurring in the case where the display gradation does not exist at the bit boundary are prevented.

Figure 15:
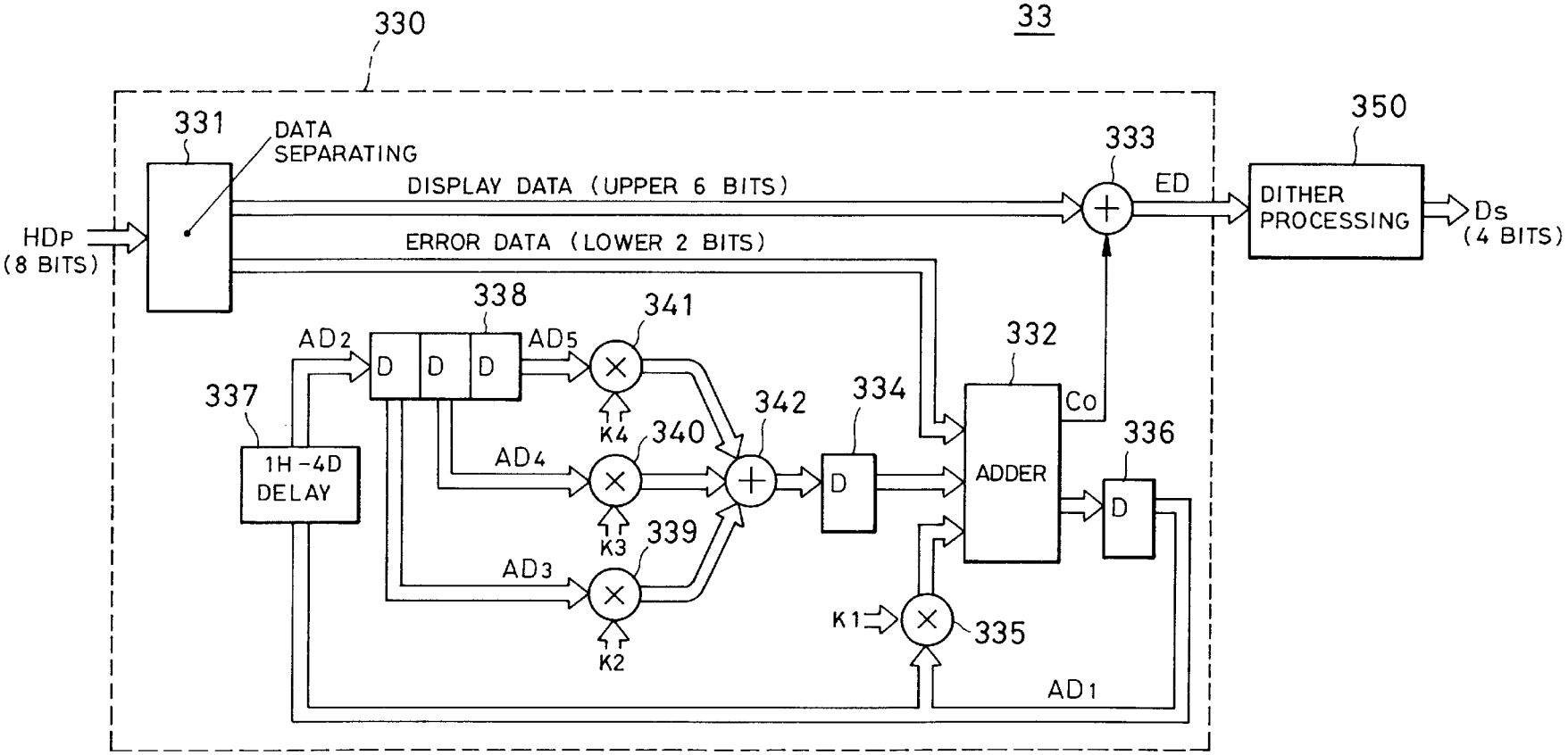
FIG. 15 is a diagram showing an internal construction of a multi-gradation processing circuit 33.

FIG. 15 is a diagram showing an interval construction of the multi-gradation processing circuit 33.

AS shown in FIG. 15, the multi-gradation processing circuit 33 is constructed by an error diffusion processing circuit 330 and a dither processing circuit 350.

A data separating circuit 331 in the error diffusion processing circuit 330 separates two lower bits in the conversion pixel data $HD_P$ of 8 bits supplied from the first data converting circuit 32 as error data and separates six upper bits as display data. An adder 332 adds the data of two lower bits in the conversion pixel data $HD_P$ as error data, a delay output from a delay circuit 334, and a multiplication output of a coefficient multiplier 335 and supplies a resultant addition value to a delay circuit 336. The delay circuit 336 delays the addition value supplied from the adder 332 by only a delay time D having the same time as the clock period of the pixel data and supplies a resultant signal as a delay addition signal $AD_1$ to the coefficient multiplier 335 and a delay circuit 337, respectively. The coefficient multiplier 335 multiplies the delay addition signal $AD_1$ by a predetermined coefficient value $K_1$ (for example, "7/16") and supplies an obtained multiplication result to the adder 332. The delay circuit 337 further delays the delay addition signal $AD_1$ by only a time; (one horizontal scanning period—4×the delay time D). The delay circuit 337 supplies a resultant signal as a delay addition signal $AD_2$ to a delay circuit 338. The delay circuit 338 further delays the delay addition signal $AD_2$ by only the delay time D and supplies a resultant signal as a delay addition signal $AD_3$ to a coefficient multiplier 339.

The delay circuit 338 further delays the delay addition signal $AD_2$ by only the delay time D×2 and supplies a resultant signal as a delay addition signal $AD_4$ to a coefficient multiplier 340. Further, the delay circuit 338 delays the delay addition signal $AD_2$ by only the delay time D×3 and supplies a resultant signal as a delay addition signal $AD_5$ to a coefficient multiplier 341. The coefficient multiplier 339 multiplies the delay addition signal $AD_3$ by a predetermined coefficient value $K_2$ (for example, "3/16") and supplies an obtained multiplication result to the adder 342. The coefficient multiplier 340 multiplies the delay addition signal $AD_4$ by a predetermined coefficient value $K_3$ (for example, "5/16") and supplies an obtained multiplication result to the adder 342. The coefficient multiplier 341 multiplies the delay addition signal $AD_5$ by a predetermined coefficient value $K_4$ (for example, "1/16") and supplies an obtained multiplication result to the adder 342. The adder 342 adds the multiplication results supplied from the coefficient multipliers 339, 340, and 341 and supplies an obtained addition signal to the delay circuit 334. The delay circuit 334 delays the addition signal by only the delay time D and supplies a resultant signal to the adder 332. The adder 332 generates a carry-out signal $C_o$ and supplies it to an adder 333. The carry-out signal $C_o$ is set to the logic level "0" in the case where there is no carry when the data of two lower bits in the conversion pixel data $HD_P$, a delay output from the delay circuit 334, and a multiplication output of the coefficient multiplier 335 are added. The carry-out signal $C_o$ is set to the logic level "1" when there is a carry. The adder 333 adds the carry-out signal $C_o$ to display data comprising six upper bits in the conversion pixel data $HD_P$ and generates resultant data as error diffusion processing pixel data ED of 6 bits. That is, the number of bits of the error diffusion processing pixel data ED is smaller than that of the conversion pixel data $HD_P$.

The operation of the error diffusion processing circuit 330 will now be described as follows.

Figure 16:
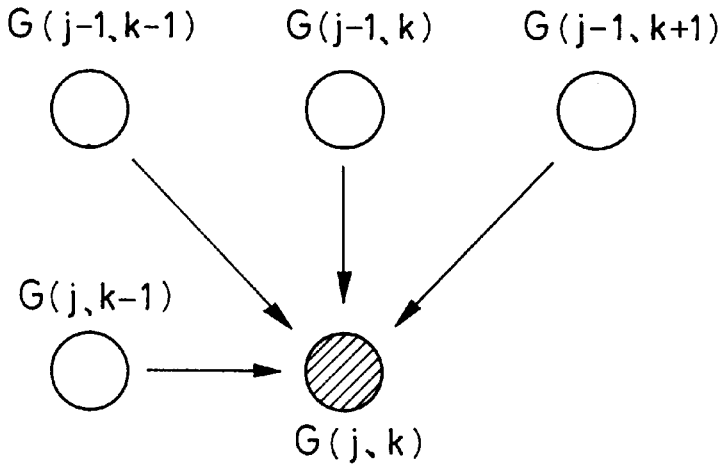
FIG. 16 is a diagram for explaining the operation of an error diffusion processing circuit 330.

For example, for obtaining the error diffusion processing pixel data ED corresponding to a pixel G(j, k) of the PDP 10 as shown in FIG. 16, first, each of the error data corresponding to a left lateral pixel G(j, k−1), an oblique upper left pixel G(j−1, k−1), a just above pixel G(j−1, k), and an oblique upper right pixel G(j−1, k+1) of the pixel G(j, k), namely, error data corresponding to the pixel G(j, k−1):
delay addition signal $AD_1$ error data corresponding to the pixel G(j−1, k+1):
delay addition signal $AD_3$ error data corresponding to the pixel G(j−1, k):
delay addition signal $AD_4$ error data corresponding to the pixel G(j−1, k−1):
delay addition signal $AD_5$ is weighted and added by the predetermined coefficient values $K_1$ to $K_4$ as mentioned above, respectively. Subsequently, the data of two lower bits of the conversion pixel data $HD_P$ namely, the error data corresponding to the pixel G(j, k) is added to its addition result. A resultant carry-out signal $C_o$ of one bit obtained in this instance is added to the data of six upper bits in the conversion pixel data $HD_P$, namely, the display data corresponding to the pixel G(j, k) and resultant data is used as error diffusion processing pixel data ED.

By the construction, in the error diffusion processing circuit 330, the data of six upper bits in the conversion pixel data $HD_P$ is regarded as display data and the data of remaining two lower bits is regarded as error data, the error data in each of the peripheral pixels {G(j, k−1), G(j−1, k+1), G(j−1, k), G(j−1, k−1)} is weighted and added, and the resultant data is reflected to the display data. By the operation, the luminance corresponding to two lower bits in the original pixel {G(j, k) is falsely expressed by the peripheral pixels, so that the luminance gradation expression that is equivalent to that of the pixel data of 8 bits can be realized by the display data of the number of bits, namely, 6 bits smaller than 8 bits.

If the coefficient values of the error diffusion were uniformly added to each pixel, noise due to an error diffusion pattern is visually confirmed, so that the picture quality deteriorates. The coefficients $K_1$ to $K_4$ of the error diffusion to be allocated to the four pixels, therefore, can be changed every field in a manner similar to a case of dither coefficients, which will be explained as follows.

The dither processing circuit 350 performs a dither process to the error diffusion processing pixel data ED of 6 bits supplied from the error diffusion processing circuit 330, thereby generating multi-gradation processing pixel data $D_s$ in which the number of bits is reduced to 4 bits while maintaining a luminance gradation level equivalent to the error diffusion processing pixel data ED. In the dither process, one intermediate display level is expressed by a plurality of adjacent pixels. For example, in the case of performing the gradation display corresponding to 8 bits by using the pixel data of six upper bits in the pixel data of 8 bits, four pixels which are neighboring in the lateral and vertical directions are used as one set and four dither coefficients a to d comprising different coefficient values are respectively allocated to the pixel data corresponding to each pixel of one set, and resultant data is added. According to the dither process, a combination of four different intermediate display levels occurs in four pixels. Even if the number of bits of the pixel data is equal to 6, therefore, the number of luminance gradation levels which can be expressed is increased four times, namely, the halftone display corresponding to 8 bits can be performed.

If the dither pattern comprising the dither coefficients a to d is uniformly added to each pixel, however, the noise due to the dither pattern is visually confirmed, so that the picture quality deteriorates.

In the dither processing circuit 350, therefore, the dither coefficients a to d to be allocated to the four pixels are changed in each field.

Figure 17:
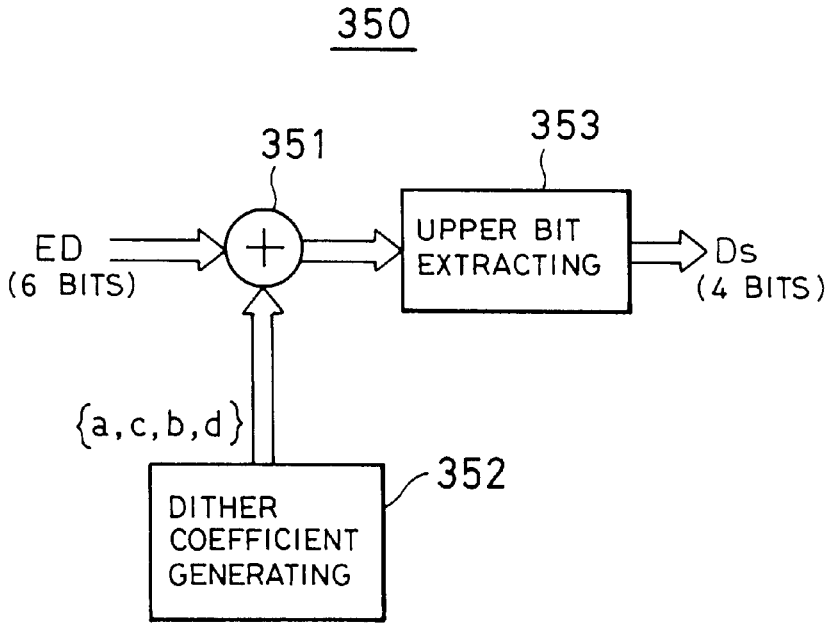
FIG. 17 is a diagram showing an internal construction of a dither processing circuit 350.

FIG. 17 is a diagram showing an internal construction of the dither processing circuit 350.

Figure 18:
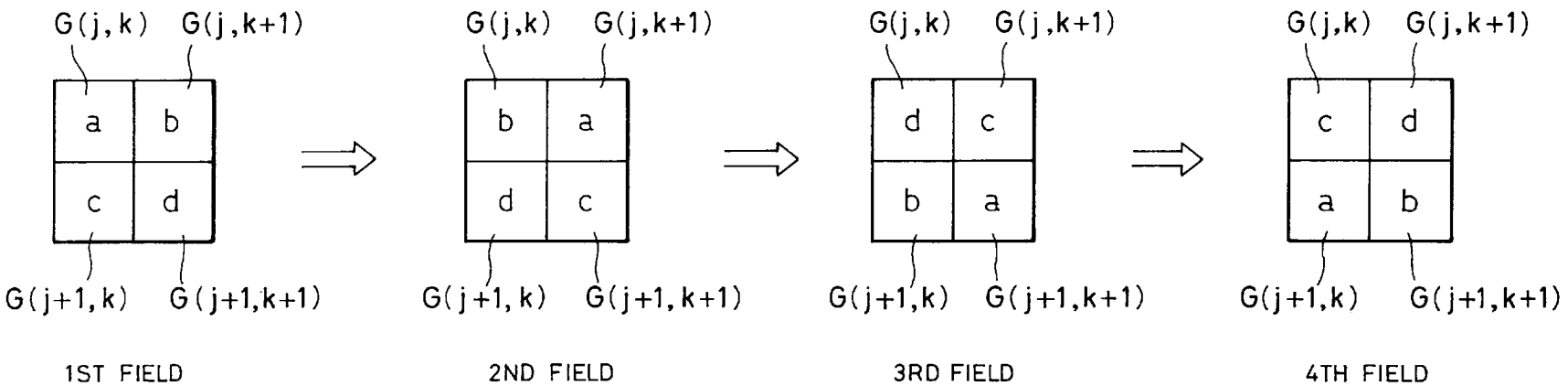
FIG. 18 is a diagram for explaining the operation of the dither processing circuit 350.

In FIG. 17, a dither coefficient generating circuit 352 generates the four dither coefficients a to d every four adjacent pixels and sequentially supplies them to an adder 351. For example, the four dither coefficients a to d are generated for the four pixels comprising the pixel G(j, k) and pixel G(j, k+1) corresponding to the j-th row and the pixel G(j+1, k) and pixel G(j+1, k+1) corresponding to the (j+1)-th row as shown in FIG. 18. In this instance, the dither coefficient generating circuit 352 changes the dither coefficients a to d to be allocated to the four pixels every field as shown in FIG. 18.

That is, the dither coefficients a to d are cyclically repetitively generated by allocating as follows and are supplied to the adder 351.

In the first field, pixel G(j, k):dither coefficient a pixel G(j, k+1): dither coefficient b pixel G(j+1, k): dither coefficient c pixel G(j+1, k+1): dither coefficient d In the second field, pixel G(j, k): dither coefficient b pixel G(j, k+1): dither coefficient a pixel G(j+1, k): dither coefficient d pixel G(j+1, k+1): dither coefficient c In the third field, pixel G(j, k): dither coefficient d pixel G(j, k+1): dither coefficient c pixel G(j+1, k): dither coefficient b pixel G(j+1, k+1): dither coefficient a In the fourth field, pixel G(j, k): dither coefficient c pixel G(j, k+1): dither coefficient d pixel G(j+1, k): dither coefficient a pixel G(j+1, k+1): dither coefficient b The dither coefficient generating circuit 352 repetitively execute the operations of the first to fourth fields as mentioned above. That is, after completion of the dither coefficient generating operation in the fourth field, the operation is returned to the operation of the first field and the foregoing operations are repeated.

The adder 351 respectively adds the dither coefficients a to d allocated to each field as mentioned above to the error diffusion processing pixel data ED corresponding to each of the pixel G(j, k), pixel G(j, k+1), pixel G(j+1, k), and pixel G(j+1, k+1) which are supplied from the error diffusion processing circuit 330 and supplies the obtained dither addition pixel data to an upper bit extracting circuit 353.

For example, in the first field shown in FIG. 18, the error diffusion processing pixel data ED corresponding to the pixel G(j, k)+dither coefficient a, the error diffusion processing pixel data ED corresponding to the pixel G(j, k+1)+dither coefficient b, the error diffusion processing pixel data ED corresponding to the pixel G(j+1, k)+dither coefficient c, and the error diffusion processing pixel data ED corresponding to the pixel G(j+1, k+1)+dither coefficient d are sequentially supplied as dither addition pixel data to the upper bit extracting circuit 353.

The upper bit extracting circuit 353 extracts up to data of four upper bits of the dither addition pixel data and supplies it as multi-gradation processing pixel data $D_s$ to a second data converting circuit 34 shown in FIG. 8.

The second data converting circuit 34 converts the multi-gradation processing pixel data $D_s$ of 4 bits into conversion pixel data HD of 14 bits in accordance with a conversion table as shown in FIG. 19.

As mentioned above, first, by performing the multi-gradation process such as error diffusion and dither process to the 8-bit pixel data D, the data converting circuit 30 obtains the multi-gradation processing pixel data $D_s$ in which the number of bits is reduced to 4 bits while maintaining the number of gradations of the visual luminance. Subsequently, the multi-gradation processing pixel data $D_s$ is converted into the conversion pixel data HD of 14 bits to actually drive the PDP 10 in accordance with the conversion table as shown in FIG. 19.

The conversion pixel data HD of 14 bits converted and generated from the data converting circuit 30 is sequentially written into the memory 4 in FIG. 7 in accordance with a write signal supplied from the drive control circuit 2. When the writing of the conversion pixel data $HD_{11-nm}$ of one picture plane (n rows, m columns) is finished by the writing operation, the memory 4 divides the conversion pixel data $HD_{11-nm}$ of one picture plane every bit digit in accordance with a read signal supplied from the drive control circuit 2 in the following manner.

That is, $DB1_{11-nm}$: the 1st bit of the conversion pixel data $HD_{11-nm}$ $DB2_{11-nm}$: the 2nd bit of the conversion pixel data $HD_{11-nm}$ $DB3_{11-nm}$: the 3rd bit of the conversion pixel data $HD_{11-nm}$ $DB4_{11-nm}$: the 4th bit of the conversion pixel data $HD_{11-nm}$ $DB5_{11-nm}$: the 5th bit of the conversion pixel data $HD_{11-nm}$ $DB6_{11-nm}$: the 6th bit of the conversion pixel data $HD_{11-nm}$ $DB7_{11-nm}$: the 7th bit of the conversion pixel data $HD_{11-nm}$ $DB8_{11-nm}$: the 8th bit of the conversion pixel data $HD_{11-nm}$ $DB9_{11-nm}$: the 9th bit of the conversion pixel data $HD_{11-nm}$ $DB10_{11-nm}$: the 10th bit of the conversion pixel data $HD_{11-nm}$ $DB11_{11-nm}$: the 12th bit of the conversion pixel data $HD_{11-nm}$ $DB12_{11-nm}$: the 12th bit of the conversion pixel data $HD_{11-nm}$ $DB13_{11-nm}$: the 13th bit of the conversion pixel data $HD_{11-nm}$ $DB14_{11-nm}$: the 14th bit of the conversion pixel data $HD_{11-nm}$ The data $DB1_{11-nm}$, $DB2_{11-nm}$, . . . , and $DB14_{11-nm}$ is sequentially read out every row and supplied to the address driver 6.

The drive control circuit 2 supplies various timing signals to drive the PDP 10 to the address driver 6, first sustain driver 7, and second sustain driver 8 in accordance with the light emission driving format as shown in FIG. 6, respectively.

Figure 20:
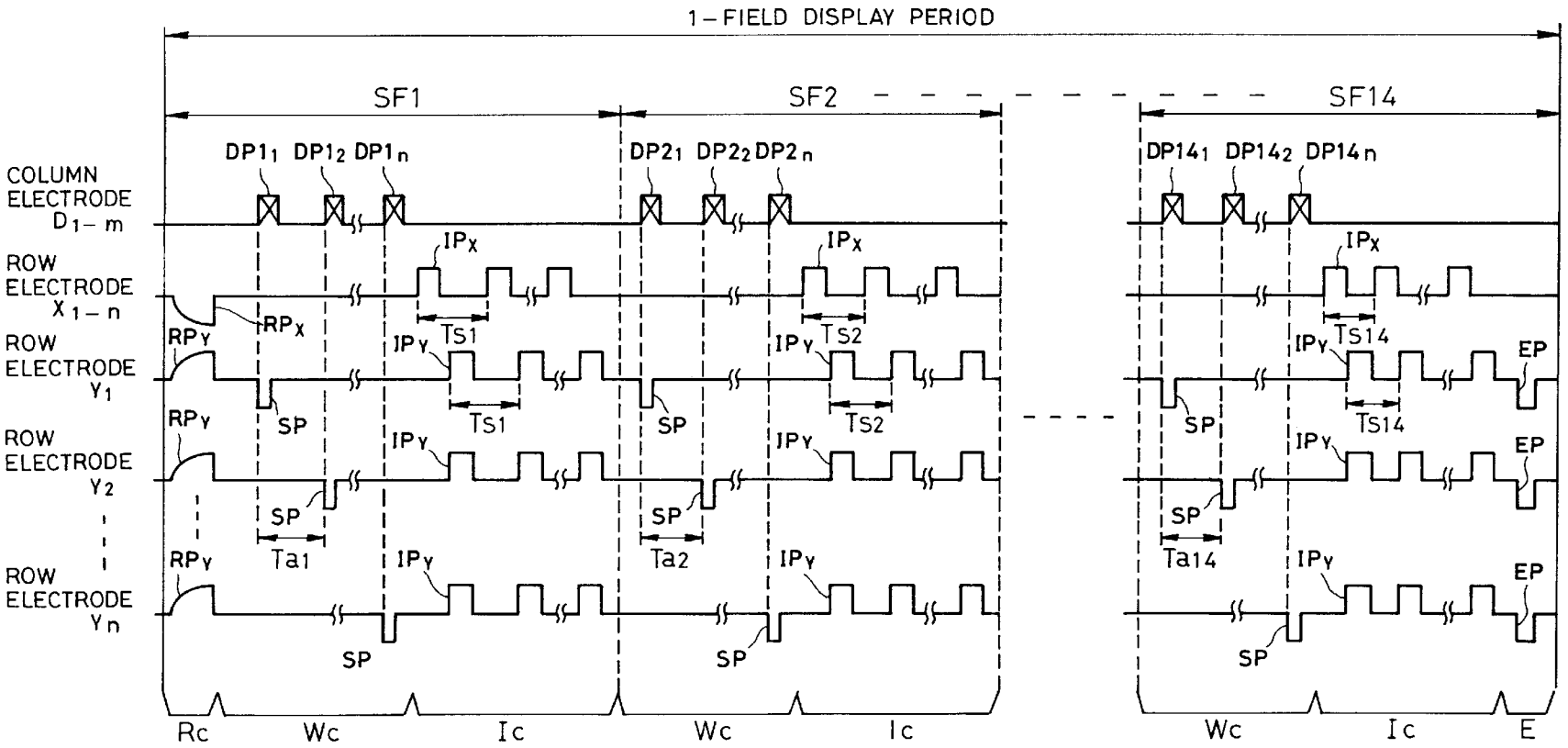
FIG. 20 is a diagram showing applying timings of various driving pulses which are applied to the PDP 10 on the basis of the light emission driving format shown in FIG. 6.

FIG. 20 is a timing diagram showing apply times of the various driving pulses which are applied to the column electrodes $D_1$ to $D_m$ and row electrodes $X_1$ to $X_n$ and $Y_1$ to $Y_n$ of the PDP 10 by the address driver 6, first sustain driver 7, and second sustain driver 8 in response to the various timing signals supplied from the drive control circuit 2.

In FIG. 20, first, in the all—resetting step $R_c$ which is executed in only the sub-field SF1, the first sustain driver 7 and second sustain driver 8 simultaneously apply the reset pulse $RP_X$ of a negative polarity and the reset pulse $RP_Y$ of a positive polarity as shown in the diagram to the row electrodes $X_1$ to $X_n$ and $Y_1$ to $Y_n$. By applying the reset pulses $RP_X$ and $RP_Y$, all discharge cells in the PDP 10 are reset-discharged and predetermined wall charges are uniformly formed in each discharge cell. All discharge cells in the PDP 10 are, thus, once initially set to the "light emitting cells".

Subsequently, in the pixel data writing step $W_C$ of each sub-field, the address driver 6 generates the pixel data pulse groups $DP1_{11-nm}$ to $DP14_{11-nm}$ each having a voltage corresponding to the logic level from $DB1_{11-nm}$ to $DB14_{11-nm}$ supplied from the memory as mentioned above. The address driver 6 allocates the pixel data pulse groups $DP1_{11-nm}$ to $DP14_{11-nm}$ to the sub-fields SF1 to SF14 as shown in FIG. 20, respectively, and sequentially applies them to the column electrodes $D_{1-m}$ every sub-field one row by one. For example, in the pixel data writing step $W_C$ of the sub-field SF1, first, the data corresponding to the first row, namely, $DB1_{11-1m}$ is extracted from $DB1_{11-nm}$ and a pixel data pulse group $DP1_1$ comprising m pixel data pulses corresponding to the logic level of each of $DB1_{11-1m}$ is generated and applied to the column electrodes $D_{1-m}$. Subsequently, $DB1_{21-2m}$ corresponding to the second row of $DB1_{11-nm}$ is extracted and a pixel data pulse group $DP1_2$ comprising m pixel data pulses corresponding to the logic level of each of $DB1_{21-2m}$ is generated and simultaneously applied to the column electrodes $D_{1-m}$. In a manner similar to the above, in the pixel data writing step $W_C$ of the sub-field SF1, pixel data pulse groups $DP1_3$ to $DP1_n$ of every row are sequentially applied to the column electrodes $D_{1-m}$. It is assumed that the address driver 6 generates the pixel data pulses of a high voltage when the logic level of DB1 is equal to, for example, "1" and generates the pixel data pulses of a low voltage (0 volt) when the logic level of DB1 is equal to "0". In the pixel data writing step $W_C$ of the sub-field SF2, the data corresponding to the first row, namely, $DB2_{11-m}$ is extracted from $DB2_{11-nm}$ and a pixel data pulse group $DP2_1$ comprising m pixel data pulses corresponding to the logic level of each of $DB2_{11-1m}$ is generated and applied to the column electrodes $D_{1-m}$. Subsequently, $DB2_{21-2m}$ corresponding to the second row of $DB2_{11-nm}$ is extracted and a pixel data pulse group $DP2_2$ comprising m pixel data pulses corresponding to the logic level of each of $DB2_{21-2m}$ is generated and applied to the column electrodes $D_{1-m}$. In a manner similar to the above, in the pixel data writing step $W_C$ of the sub-field SF2, pixel data pulse groups $DP2_3$ to $DP2_n$ of every row are sequentially applied to the column electrodes $D_{1-m}$.

Even in the pixel data writing step $W_C$ of each of the sub-fields SF3 to SF14, in a manner similar to the above method, the address driver 6 generates pixel data pulse groups $DP3_{1-n}$ to $DP14_{1-n}$ from respective $DB3_{11-nm}$ to $DB14_{11-nm}$ and sequentially applies them to the column electrodes $D_{1-m}$ every row.

The second sustain driver 8 generates the scanning pulses SP of a negative polarity as shown in FIG. 20 at the same timing as the applying timing of each of the pixel data pulse group DP as mentioned above and sequentially applies them to the row electrodes $Y_1$ to $Y_n$. In this instance, a discharge (selective erasure discharge) occurs in only the discharge cell in the intersecting portion of the "row" to which the scanning pulse SP was applied and the "column" to which the pixel data pulse of the high voltage was applied. The wall charges remaining in the discharge cell are selectively erased. By the selective erasure discharge, the discharge cells initialized to the state of the "light emitting cells" in the all—resetting step $R_c$ are shifted to the "non-light emitting cells". No discharge is caused in the discharge cells formed on the "column" to which the pixel data pulse of the low voltage was applied and the state initialized in all-resetting step $R_c$, namely, the state of the "light emitting cells" is maintained.

In this instance, the apply period of the operation to apply the scanning pulses SP which is executed in the pixel data writing step $W_c$ of each of the sub-fields SF1 to SF14 is set to be different every sub-field.

That is, the scanning pulse period $T_{a1}$ in the sub-field SF1 and the scanning pulse period $T_{a2}$ in the sub-field SF2 as shown in FIG. are set to the different period duration. Further, the scanning pulse period $T_{a2}$ and the scanning pulse period $T_{a3}$ in the sub-field SF3 are set to the different period duration.

Consequently, the spectrum of radiation noise which is generated by the pulse train of the scanning pulses is concentrated to a predetermined frequency is prevented, thereby reducing the radiation noise.

In the light emission sustaining step $I_c$ of each of the sub-fields SF1 to SF14, the first sustain driver 7 and second sustain driver 8 alternately apply the sustaining pulses $IP_X$ and $IP_Y$ of a positive polarity to the row electrodes $X_1$ to $X_n$ and $Y_1$ to $Y_n$. In the light emission sustaining step $I_c$ in each sub-field, the number of times (period) of applying the sustaining pulses $IP_X$ and $IP_Y$ is set for each sub-field SF. That is, as shown in FIG. 6, when the number of times of light emitting in the sub-field SF1 is set to "1", the sustaining pulses $IP_X$ and $IP_Y$ are applied by only the number shown by the following rates of the number of times (period) in the light emission sustaining step $I_c$ in each sub-field.

SF1:1
SF2:3
SF3:5
SF4:8
SF5:10
SF6:13
SF7:16
SF8:19
SF9:22
SF10:25
SF11:28
SF12:32
SF13:35
SF14:39

By applying the sustaining pulses IP, the discharge cells in which the wall charges remain in the pixel data writing step $W_c$, that is, the "light emitting cells" are sustain-discharged each time the sustaining pulses $IP_X$ and $IP_Y$ are applied and maintain the discharge light emitting state by only the number of times (period) allocated to each sub-field. According to the light emission sustaining step $I_c$ of the sub-field SF1, therefore, the light emission display for the low luminance component of the input video signal is performed. According to the light emission sustaining step $I_c$ of the sub-field SF14, the light emission display for the high luminance component of the input video signal is performed.

In this instance, the apply period of the sustaining pulses IP in each sub-field, namely, the sustaining pulse periods $T_{s1}$ to $T_{s14}$ are different and have the following relation.

$$T_{s1}>T_{s2}>T_{s3} \ldots >T_{s13}>T_{s14}$$

That is, as for the sub-field in which the number of times of light emitting which is allocated is smaller, the sustaining pulse period $T_s$ as an apply period of the sustaining pulses IP is set to be longer.

Consequently, the spectrum of radiation noise which is generated by the pulse train of the respective sustaining pulses is prevented from being concentrated to a predetermined frequency, thereby reducing the radiation noise. Further, the sustaining pulse period $T_s$ in the sub-field in which the number of light emitting times which is allocated is small, namely, sub-field in which the light emission for the low luminance component is performed is set to be long. The sustaining pulse period $T_s$ in the sub-field in which the number of light emitting times which is allocated is large, namely, sub-field in which the light emission for the high luminance component is performed is set to be short by only the long sustaining pulse period. The erroneous discharge in the light emission sustaining step $I_c$ in the sub-field where the light emission for the low luminance component is performed is, consequently, prevented.

Although the correspondence relation between the apply periods of the sustaining pulses IP and scanning pulses SP and their pulse widths is not shown in FIG. 20, the pulse widths of the sustaining pulses IP and scanning pulses SP are set in accordance with the apply periods, respectively. That is, when the apply period is set to be long, the pulse width is also extended in accordance with it. When the apply period is set to be short, the pulse width is also set to be short in accordance with it.

It is also possible to provide a construction such that the sub-fields SF1 to SF4 are divided into two sub-field groups and the applying periods and pulse widths of the sustaining pulses IP and scanning pulses SP which are applied in each sub-field in the sub-field group including the head sub-field SF1 (the sub-field in which the number of times of light emitting which is allocated is the smallest are set to be longer than the apply periods and pulse width of the sustaining pulses IP and scanning pulses SP to be applied in each sub-field in the subsequent sub-field groups.

In the erasing step E in the last sub-field SF14 as shown in FIG. 20, the address driver 6 generates an erasing pulse AP and applies it to each of the column electrodes $D_{1-m}$. The second sustain driver 8 generates the erasing pulse EP simultaneously with the apply timing of the erasing pulse AP and applies it to each of the row electrodes $Y_1$ to $Y_n$. By simultaneously applying the erasing pulses AP and EP, an erasure discharge is caused in all discharge cells in the PDP 10 and the wall discharges remaining in all discharge cells are extinguished. That is, all discharge cells in the PDP 10 are set to the "non-light emitting cells" by the erasure discharge.

The plasma display apparatus shown in FIG. 7 repetitively executes the operation shown in FIG. 20, thereby performing the gradation driving of 15 stages.

That is, since the conversion pixel data HD which is used when the driving based on FIGS. 6 and 20 is performed has only 15 patterns as shown in FIG. 19, the number of all patterns of the light emission driving which is executed in one field display period is also equal to 15 as shown in FIG. 19.

In this instance, a black circle shown in FIG. 19 indicates that the selective erasure discharge is performed in the pixel data writing step $W_c$ in the sub-field. That is, by the all-resetting step $R_c$ in the head sub-field SF1 of one field, the wall charges formed in all discharge cells of the PDP 10 continuously remain until the selective erasure discharge is executed and the sustaining discharge accompanied with the light emission is caused (shown by a white circle) in the light emission sustaining step $I_c$ in each of the sub-fields SF existing for that period of time. As mentioned above, each discharge cell becomes the "light emitting cell" until the selective erasure discharge is performed in one field and repeats the light emission by only the number of times corresponding to each sub-field in the light emission sustaining step $I_c$ in each of the sub-fields existing for that period of time.

According to the light emission driving pattern as shown in FIG. 19, the gradation driving of 15 stages in which the light emission luminance rates are set to

{0, 1, 4, 9, 17, 27, 40, 56, 75, 97, 122, 150, 182, 217, 256} is executed.

The pixel data D which is supplied from the A/D converter 1, however, expresses the halftone of 8 bits, namely, 256 stages. To realize the halftone display close to 256 stages even by the gradation driving of 15 stages, therefore, in the plasma display apparatus shown in FIG. 7, the multi-gradation process such as error diffusion and dither is performed by the multi-gradation processing circuit 33 shown in FIG. 8.

In the plasma display apparatus shown in FIG. 7 as mentioned above, the resetting step $R_c$ is executed only in the head sub-field of one field and the selective erasure discharge is performed in only the pixel data writing step $W_c$ of any of the sub-fields in one field as shown in FIGS. 6 and 19.

Even in case of using the driving method, as shown in FIG. 20, by making the apply periods of the sustaining pulses IP and scanning pulses SP different every sub-field, the spectrum of radiation noise is prevented from being concentrated to a predetermined frequency, thereby reducing the radiation noise. Further, as for the sub-field in which the number of times of light emitting to be allocated is smaller, the apply period of the sustaining pulses IP is set to be longer and the sustaining pulse period $T_s$ in the sub-field in which the number of times of light emitting to be allocated is larger is shortened by only the time corresponding to that long apply period, so that the erroneous discharge in the light emission sustaining step $I_c$ can be prevented.

In the embodiment, the selective erasure discharge is caused in the pixel data writing step $W_c$ in any of the sub-fields SF1 to SF14.

In a case where if an amount of charged particles remaining in the discharge cell is small, however, even if the scanning pulse SP and the pixel data pulse of the high voltage are simultaneously applied, the selective erasure discharge is not normally performed and the wall charges in the discharge cell cannot be erased. In this instance, even when the pixel data D after the A/D conversion is the data showing a low luminance, the light emission corresponding to the highest luminance is performed and a problem occurs in which the image quality remarkably deteriorates.

In place of the light emission driving pattern shown in FIG. 19, therefore, the erroneous light emitting operation can be prevented by using a light emission driving pattern shown in FIG. 21.

In the light emission driving pattern shown in FIG. 21, the selective erasure discharge is continuously performed (shown by a black circle) in the pixel data writing step $W_c$ in each of the two continuous sub-fields.

According to the operation, even if the wall charges in the discharge cell cannot be normally extinguished by the selective erasure discharge the first time, the wall charges can be normally extinguished by the selective erasure discharge the second time, so that the erroneous light emitting operation can be prevented as mentioned above.

It is not always necessary to perform the selective erasure discharge two times between the continuous sub-fields.

For example, as shown in FIG. 22, after the first selective erasure discharge was finished, the second selective erasure discharge can be performed after an elapse of one sub-field. In brief, it is sufficient to perform the second selective erasure discharge in any of the sub-fields after the end of the first selective erasure discharge.

The number of times of the selective erasure discharge which is performed in one field period is not limited to 2.

For example, as shown in FIG. 23, the third and forth selective erasure discharge is performed in any of the sub-fields (shown by a triangle) after the end of the second selective erasure discharge, thereby allowing the wall charges to be certainly extinguished.

As mentioned above, according to the invention, by making the apply periods of at least one of the scanning pulses and the sustaining pulses different for every sub-field or plural fields, the spectrum of the radiation noise which is generated due to the pulse train of the driving pulses is distributed, thereby reducing the radiation noise.

Further, by extending the sustaining pulse period in the sub-field in which the number of times of light emitting is small, the erroneous discharge in the sub-field in which the number of times of light emitting is small is suppressed.

According to the invention, consequently, the radiation noise is reduced while preventing an erroneous discharge and the display quality is improved.

What is claimed is:

1. A method for driving a plasma display panel having discharge cells each corresponding to one pixel formed at each of intersecting points between a plurality of row electrodes arranged at respective scanning lines and a plurality of column electrodes intersecting said row electrodes, in response to a video signal, at each of successively appearing sub-fields forming each of the fields of said video signal, which comprises:

in each of said sub-fields, executing a pixel data writing step of sequentially applying a scanning pulse to cause a selective discharge to set said discharge cell to one of a light emitting cell and a non-light emitting cell in accordance with pixel data to each of said row electrodes; and a light emission sustaining step of applying a sustaining pulse to cause a sustaining discharge in only the light emitting cell to each of said row electrodes by only a number of times corresponding to a weight of said sub-field, in which either one of said scanning pulses and said sustaining pulses changes in its repetitive period between at least two of said sub-fields.

2. A method for driving a plasma display panel having discharge cells each corresponding to one pixel formed at each of intersecting points between a plurality of row electrodes arranged at the respective scanning lines and a plurality of column electrodes intersecting said row electrodes, in response to a video signal, at each of successively appearing sub-fields forming each of the fields of said video signal, which comprises:

in each of said sub-fields, executing a pixel data writing step of sequentially applying a scanning pulse to cause a selective discharge to set said discharge cell to one of a light emitting cell and a non-light emitting cell in accordance with pixel data to each of said row electrodes; and a light emission sustaining step of applying a sustaining pulse to cause a sustaining discharge in only the light emitting cell to each of said row electrodes by only a number of times corresponding to a weight of said sub-field, in which either one of said scanning pulses and said sustaining pulses changes in its repetitive period between at least two of the fields.

3. A method for driving a plasma display panel having discharge cells each corresponding to one pixel formed at each of intersecting points between a plurality of row electrodes arranged at the respective scanning lines and a plurality of column electrodes intersecting said row electrodes, in response to a video signal, at each of successively appearing sub-fields forming each of the fields of said video signal, which comprises:

a resetting step for causing a reset discharge to initialize all of said discharge cells to a state of one of light emitting cells and non-light emitting cells in only said sub-field of a head portion in a display period of said one field;

a pixel data writing step for causing selective discharge in accordance with pixel data at said pixel data writing step in one of said plurality of sub-fields, thereby setting said discharge cell to one of said non-light emitting cell and said light emitting cell; and a light emission sustaining step for applying a sustaining pulse to each of said row electrodes in each of said plurality of sub-fields by only a number of times corresponding to a weight of said sub-field, thereby causing a sustaining discharge in only said light emitting cell, wherein an applying period of said sustaining pulse in the sub-field having a relatively small number of sustaining pulses is longer than an applying period of said sustaining pulse having a relatively large number of said sustaining pulses.

4. A method according to claim 3, wherein in said pixel data writing step in at least one sub-field which is executed after said one sub-field, said selective discharge to set said discharge cell to said one state is performed again.

5. A method according to claim 3, further comprising an erasing step of causing a discharge to set all of said discharge cells to the state of said non-light emitting cell in only a last one of said plurality of sub-fields.

6. A method according to claim 3, wherein in said resetting step, wall charges are formed in all of said discharge cells by said reset discharge and all of said discharge cells are initialized to the state of said light emitting cell, and in said pixel data writing step, said wall charges formed in said discharge cells are extinguished by said selective discharge and said discharge cells are set to said non-light emitting cells.

* * * * *